US005710580A

United States Patent [19]

Otsuka et al.

[11] Patent Number: 5,710,580

[45] Date of Patent: Jan. 20, 1998

[54] INK JET RECORDING HEAD AND INK JET RECORDING APPARATUS PROVIDED WITH THE RECORDING HEAD

[75] Inventors: Naoji Otsuka, Kawasaki; Hiromitsu Hirabayashi, Yokohama; Atsushi Arai, Kawasaki; Hirofumi Hirano, Yokohama; Kentaro Yano, Yokohama; Hitoshi Sugimoto, Yokohama; Masaharu Ikado, Yokohama, all of Japan

[73] Assignee: Canon Kabushiki Kaisha, Tokyo, Japan

[21] Appl. No.: 789,060

[22] Filed: Jan. 28, 1997

Related U.S. Application Data

[63] Continuation of Ser. No. 380,143, Jan. 27, 1995, abandoned, which is a continuation of Ser. No. 104,592, Aug. 10, 1993, abandoned, which is a continuation of Ser. No. 748,824, Aug. 22, 1991, abandoned.

[30] Foreign Application Priority Data

Aug. 24, 1990 [JP] Japan ..... 2-223474

[51] Int. Cl.[6] ..... B41J 2/165

[52] U.S. Cl. ..... 347/32

[58] Field of Search ..... 347/22, 29–33

[56] References Cited

U.S. PATENT DOCUMENTS

| | | | |
|---|---|---|---|
| 3,999,190 | 12/1976 | Brown et al. | 346/140 R |
| 4,126,868 | 11/1978 | Kirner | 346/140 R |
| 4,313,124 | 1/1982 | Hara . | |
| 4,345,262 | 8/1982 | Shirato et al. . | |
| 4,459,600 | 7/1984 | Sato et al. . | |
| 4,463,359 | 7/1984 | Ayata et al. . | |
| 4,536,777 | 8/1985 | Matsumoto | 346/140 R |
| 4,558,333 | 12/1985 | Sugitani et al. . | |
| 4,591,870 | 5/1986 | Braun et al. | 346/1.1 |
| 4,723,129 | 2/1988 | Endo et al. . | |
| 4,740,796 | 4/1988 | Endo et al. . | |
| 4,829,318 | 5/1989 | Racicot et al. | 346/1.1 |
| 4,839,664 | 6/1989 | Archer et al. | 346/1.1 |
| 4,849,769 | 7/1989 | Dressler | 346/1.1 |
| 4,855,764 | 8/1989 | Humbs et al. | 346/140 R |
| 4,935,753 | 6/1990 | Lehmann et al. | 347/33 |
| 5,027,134 | 6/1991 | Harmon et al. | 346/140 R |
| 5,081,472 | 1/1992 | Fisher | 346/140 R |
| 5,126,765 | 6/1992 | Nakamura | 346/140 R |
| 5,142,297 | 8/1992 | Eijkman et al. | 346/1.1 |
| 5,151,715 | 9/1992 | Ward et al. | 346/140 R |

FOREIGN PATENT DOCUMENTS

| | | | |
|---|---|---|---|
| 52-49032 | 4/1977 | Japan . | |
| 55-79174 | 6/1980 | Japan . | |
| 55-142664 | 11/1980 | Japan . | |
| 57-129753 | 8/1982 | Japan . | |
| 57-133076 | 8/1982 | Japan . | |
| 58-14762 | 1/1983 | Japan . | |
| 59-123670 | 7/1984 | Japan . | |
| 59-138461 | 8/1984 | Japan . | |
| 1230949 | 10/1986 | Japan | 347/33 |
| 3090362 | 4/1991 | Japan | 347/33 |

*Primary Examiner*—William J. Royer

*Attorney, Agent, or Firm*—Fitzpatrick, Cella, Harper & Scinto

[57] ABSTRACT

An ink jet recording head mountable in a recording apparatus, provided with a cleaning member capable of cleaning the ink discharging port formation surface of the recording head for discharging ink, in which there is provided for the ink jet recording head a concavity or a plurality of concavities in the traveling path of the cleaning member on the discharging port formation surface cleaned by the cleaning member at the upstream side in the traveling direction from the discharging port formation area for discharging ink; thus removing the foreign particle on the discharging port surface reliably to perform a stable recording.

91 Claims, 23 Drawing Sheets

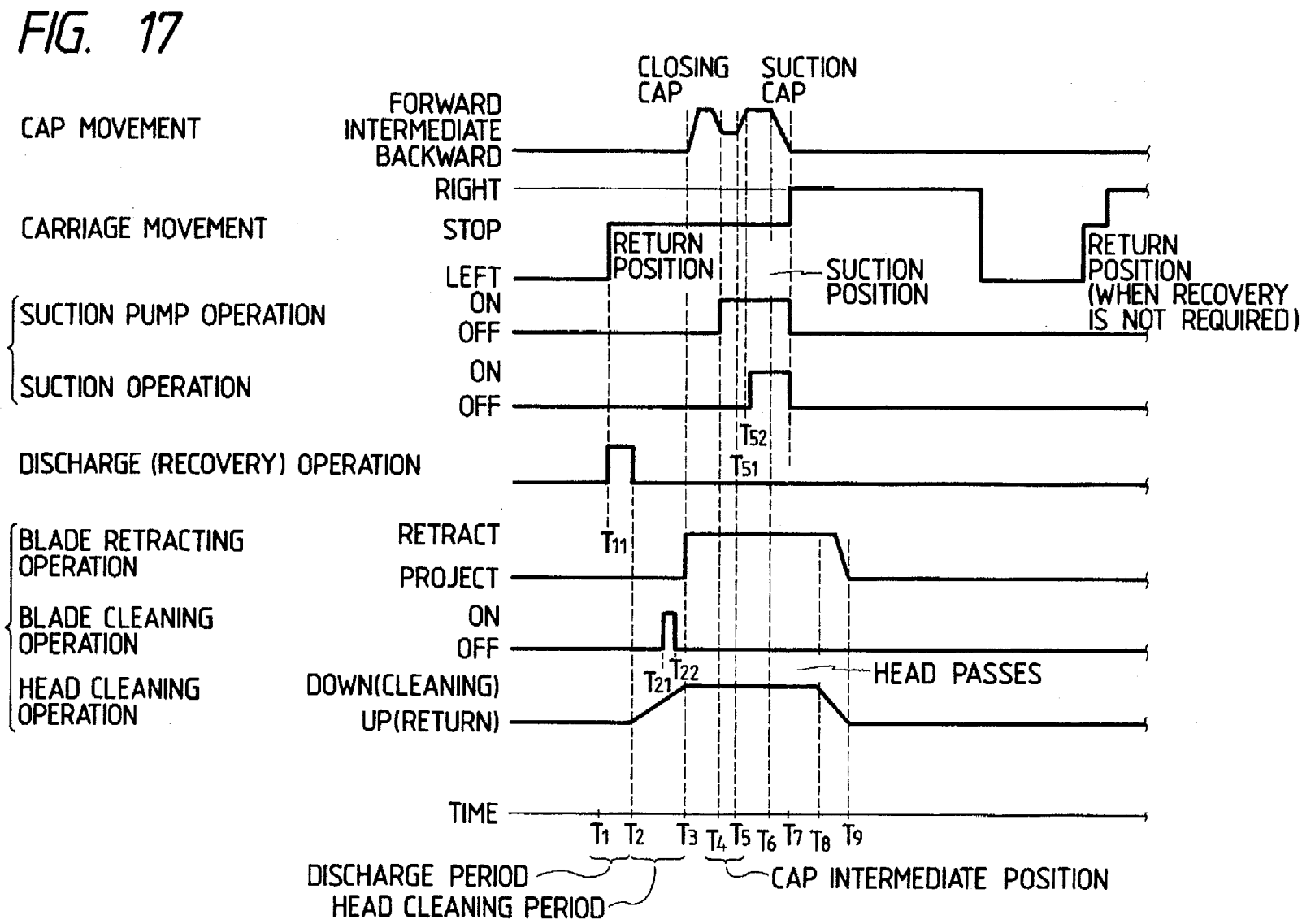
FIG. 17
CAP MOVEMENT
CARRIAGE MOVEMENT
SUCTION PUMP OPERATION
SUCTION OPERATION
DISCHARGE (RECOVERY) OPERATION
BLADE RETRACTING OPERATION
BLADE CLEANING OPERATION
HEAD CLEANING OPERATION
FORWARD
INTERMEDIATE
BACKWARD
RIGHT
STOP
LEFT
ON
OFF
ON
OFF
RETRACT
PROJECT
ON
OFF
DOWN(CLEANING)
UP(RETURN)
TIME
CLOSING CAP
SUCTION CAP
RETURN POSITION
SUCTION POSITION
RETURN POSITION (WHEN RECOVERY IS NOT REQUIRED)
T11
T52
T51
T21
T22
HEAD PASSES
T1 T2 T3 T4 T5 T6 T7 T8 T9
CAP INTERMEDIATE POSITION
DISCHARGE PERIOD
HEAD CLEANING PERIOD

INK JET RECORDING HEAD AND INK JET RECORDING APPARATUS PROVIDED WITH THE RECORDING HEAD

This application is a continuation of application Ser. No. 08/380,143, filed Jan. 27, 1995, which is a continuation of application Ser. No. 08/104,592, filed Aug. 10, 1993, which is a continuation application of application Ser. No. 07/748,824, filed Aug. 22, 1991, all now abandoned.

BACKGROUND OF THE INVENTION

1. Field of the Invention

The present invention relates to an ink jet recording head and an ink jet recording apparatus provided with the aforesaid ink jet head. More particularly, the present invention relates to an ink jet recording head applicable to a recording apparatus provided with means for cleaning the discharging port formation surface of the recording head, an ink jet recording apparatus with the cleaning mechanism which utilizes the aforesaid recording head, and a recording apparatus provided with the aforesaid recording head.

2. Related Background Art

Traditionally, as means for cleaning the discharging port formation surface of a recording head, means which performs its control mechanically or electrically has been adopted in order to operate a mechanism using an ink absorbent or a blade appropriately.

As the structure of a discharging unit having many discharging ports for a recording head, there have been known those with the discharging ports which are arranged in rows (in a row, staggered compound rows, and the like) or arranged irregularly (on a curving surface, a plurality of staggered compound rows, and the like) with fine blow holes, which are different from the discharging ports, for non-recording use (but for pressure wave damping, unwanted gas exhausting, or correction of fabrication irregularity) in order to enable the discharging ports to meet predetermined recording conditions. In FIG. 21, an ink jet recording apparatus that the applicant thereof has proposed previously is illustrated. As represented by the disassembled perspective view shown in FIG. 21, this ink jet recording apparatus is provided with an orifice plate 2002 having the discharging ports 2001 to discharge ink; a ceiling plate 2004 having the grooves 2003 which form the ink paths connectively communicative with each of the discharging ports, and heater board 2006 having heating units 2005 of an electrothermal converter serving as a thermal energy generating element for generating the thermal energy utilized for discharging ink provided in the ink paths. Here a reference numeral 2007 designates an ink supply inlet to the ink paths. In general, this orifice plate 2002 is provided to construct the discharging port surface with a same member as one of its principal objects in order to prevent the deviation of ink droplets in the discharging direction due to the difference in wettabilities of the heater board 2006 and ceiling plate 2004. As an energy generating element for discharging ink, there is an element which generates heat by absorbing external energy such as electromagnetic waves or a portion which generates heat by providing ink with energy directly, or an electromechanical transducing element and the like as a pressure generating element.

Among recording apparatuses having a recording head of the kind, there are some having a specific structure for such system as performing the recording by discharging ink in addition to the structure related directly to the recording.

For example, depending on the recording data, there is such a case where no discharging is performed from a certain discharging port for a long time or the viscosity of ink in the discharging port or ink liquid chamber connectively communicative with the discharging port is increased due to evaporation to disable the discharging if the recording apparatus is not used for a long time. Also, to the discharging port surface where the discharging ports are arranged, ink droplets, water droplets, or dusts adhere, and the ink droplets being discharged are pulled by these adhesive particles so that the discharging direction is deflected. Therefore, in order to prevent such disabled discharging or deflection of the discharging direction, some of the ink jet recording apparatuses are provided with the so-called discharging recovery systems.

As these discharging recover system, there are, in addition to the above-mentioned cleaning means, a preliminary discharging thereby to discharge ink onto a predetermined ink receiving medium to remove such overly viscous ink and the like, an ink absorbing means thereby to absorb ink from the discharging ports or ink liquid chamber to perform the above-mentioned removal, or further, a capping system thereby to cover the discharging port formation surface with a cap tightly so as to prevent ink form being evaporated, or some other structures to prevent the disabled discharging.

Particularly, the method using the blade for wiping the discharge port formation surface is effective because with this, dusts, ink droplets and other particles adhering to the vicinity of the discharging ports can be removed. There is also known a method such as providing a cleaning member for the blade itself to obtain a long, stable wiping function thereof.

This discharging port formation surface cleaning is in most cases is performed before the recording head returns to its home position or while the recording head is traveling to the recording area from its home position.

Those recovering methods for the recording head using the cleaning members as mentioned above are effective because there is no need for ink to be discharged. However, the inventor hereof et al have found in their intercompany discussions in the preparatory stage to finalize the present invention that there are some cases where a part of the recording head results in defective recording after just several times of the cleaning performance. The phenomenon of such defective recording is observed only in those discharging ports near to the side where the cleaning begins. The analysis thereof provides the findings given below.

If foreign particles have adhered to the blade itself in the early stage of the cleaning operation, such foreign particles are rubbed into the discharging ports for recording when the discharging port formation surface is slidably rubbed at the subsequent cleaning, resulting in the cause of hindrance to the normal discharging. These foreign particles include dusts in the air, dirts, and further, nicotine, and it has been found that if the recording apparatus is used in an office, it is quite difficult to prevent the adherence of the foreign particles to the blade completely.

Particularly, with the blade which is a resilient member such as made of silicon rubber or chloroprene (CR) rubber generally used conventionally, it is easy to remove the pool of ink droplets on the discharging port formation surface but it is not necessarily easy to remove foreign particles such as paper dusts and dirts. As shown in FIGS. 22A through 22C, a foreign particle 2008 on the orifice plate 2002 begins to change its location by being dragged by the blade 17 for wiping. If the orifice plate 2002 is flat, the adhering particle can easily be removed, but when the dust is dragged to the plate where the discharging port 2001 is provided, the adhering particle is blocked by the discharging port 2001 to increase its traveling load, and is left behind the advancing blade. As a result, not only the attainment of the cleaning is impossible, but there often occurs the hindrance that even an foreign particle which has been not located on the discharging port to hinder the ink discharging is dragged onto the discharging port.

Therefore, in order to remove this type of foreign particle, the suction recovering means is actuated in the early stage. Then, it is comparatively easy to remove such particle. However, subsequent to the repeated cleaning without the further suction recovery, there is generated a portion where no dust removal is possible or the disabled discharging port, or there is observed an increase in the numbers of the disabled discharging port. In this respect, the amount of ink which is sucked by the suction recovering motion is sometimes equivalent to the amount of ink used for recording four to five sheets of A4 sized original. Accordingly, it is not desirable to perform the suction recovering motion in a high frequency.

The necessity of reducing the hindrance caused by the foreign particle wiping has increased significantly.

Also, the ink droplets which have adhered to the surface of the blade become the overly viscous ink having a high viscousity due to the gradual evaporation, and it has been observed that when the wiping is performed, such overly viscous ink is coated into the discharging port 2001 to hinder the normal discharging.

SUMMARY OF THE INVENTION

In consideration of the aforesaid technical problems, the present invention is designed to solve them and the object thereof is to provide a recording head capable of significantly increasing the period during which the stable recording can be performed by improving the drawbacks resulting in the defective recording because of the cleaning means.

Also, another object of the present invention is to provide a recording apparatus adopting this recording head and being capable of increasing the usable period of the recording head.

Further, still another object of the present invention is to provide a recording apparatus capable of making simpler the recovering control performed for the aforesaid recording head, so that an ink jet recording apparatus capable of reducing the aforesaid hindrance at the time of cleaning to improve the reliability of the ink discharging can be provided.

Also, a further object of the present invention is to provide a recording head exchangeable with respect to the recording apparatus and being capable of reducing ink consumption while attaining a stable recording for a long time.

In addition, it is still another object of the present invention to provide a recording head having three or more foreign particle removing portions, which are the same as the discharging ports, to solve the aforesaid cleaning problems assuredly, although it may be possible to include the energy generating element in the course of the manufacturing process as in the case of the formation of the discharging liquid paths for recording and discharging ports.

In an ink jet recording head detachable to recording apparatus having the cleaning member capable of cleaning the ink discharging formation surface of a recording apparatus discharging ink, it is still another object of the present invention to provide an ink jet recording head wherein a cavity is provided at a position in the traveling course of the cleaning member on the discharging port formation surface to be cleaned by the aforesaid cleaning member in the upstream side of the ink discharging port formation area in the aforesaid traveling direction.

In an ink jet recording apparatus in which a recording is performed by discharging ink from the recording head, it is still another object of the present invention to provide an ink jet recording head which comprises a cleaning member capable of cleaning the ink discharging port formation surface of the aforesaid recording head, and a supporting member installing therein a recording head provided with a cavity in the traveling course of the cleaning member on the discharging port formation surface to be cleaned by the aforesaid cleaning member and in the upstream side of the ink discharging port formation area in the aforesaid traveling direction.

Also, in an ink jet recording head detachable to the recording apparatus provided with a cleaning member capable of cleaning the discharging port formation surface having the ink discharging ports connectively communicative with an ink chamber, it is another object of the present invention to provide an ink jet recording head wherein an opening connectively communicative with the aforesaid ink chamber is provided at a position in the traveling course of the cleaning member on the discharging port formation surface to be cleaned by the aforesaid cleaning member in the upstream side of the ink discharging port formation area in the aforesaid traveling direction.

Also, in an ink jet recording apparatus in which a recording is performed by discharging ink from the recording head, it is still another object of the present invention to provide an ink jet recording apparatus which comprises a cleaning member capable of cleaning the ink discharging port formation surface of the aforesaid recording head, and a supporting member installing therein a recording head provided with an opening connectively communicative with the sforesaid ink chamber in the traveling course of the cleaning member on the discharging port formation surface to be cleaned by the aforesaid cleaning member and in the upstream side of the ink discharging port formation area in the aforesaid traveling direction.

Further, in an ink jet recording apparatus capable of installing a recording head discharging ink from the aforesaid discharging ports to perform the recording in such a manner that the ink discharging ports are arranged in the gravity direction, at the same time, being traveled on a recording medium in the direction intersecting the conveying direction of the aforesaid recording medium, it is still another object of the present invention to provide an ink jet recording apparatus which comprises a cleaning member for cleaning the aforesaid ink discharging formation surface in traveling from the top to the bottom in the gravity direction, and a supporting member installing therein a recording head provided with a plurality of cavities of substantially the same size of the aforesaid discharging port in the traveling course of the cleaning member on the discharging port formation surface to be cleaned by the aforesaid cleaning member and in the upper side of the ink discharging port formation area in the aforesaid traveling direction.

Further, in an ink jet recording apparatus capable of installing a recording head discharging ink from the aforesaid discharging ports to perform the recording in such a manner that the ink discharging ports are arranged in the gravity direction, at the same time, being traveled on a recording medium in the direction intersecting the conveying direction of the aforesaid recording medium, it is still another object of the present invention to provide an ink jet recording apparatus which comprises a cleaning member for cleaning the aforesaid ink discharging formation surface in traveling from the top to the bottom in the gravity direction, and a supporting member installing therein a recording head provided with a plurality of cavities of substantially the same size of the aforesaid discharging port in the traveling course of the cleaning member on the discharging port formation surface to be cleaned by the aforesaid cleaning member and in the lower side of the ink discharging port formation area in the aforesaid traveling direction.

Further, in addition, in an ink jet recording head detachable to a recording apparatus provided with a cleaning member capable of cleaning the ink discharging port formation surface of the recording head for discharging ink by conveying the cleaning member relatively in the direction intersecting the direction in which the aforesaid discharging ports are arranged, it is still another object of the present invention to provide an ink jet recording head wherein one cavity which is larger than the size of the aforesaid discharging port is provided at a position in the traveling course of the cleaning member on the discharging port formation surface to be cleaned by the aforesaid cleaning member in the upstream side of the ink discharging port formation area in the aforesaid traveling direction.

Also, in an ink jet recording apparatus capable of installing a recording head discharging ink from the aforesaid discharging ports to perform the recording in such a manner that the ink discharging ports are arranged in the gravity direction, at the same time, being traveled on a recording medium in the direction intersecting the conveying direction of the aforesaid recording medium, it is still another object of the present invention to provide an ink jet recording apparatus which comprises a cleaning member for cleaning the aforesaid ink discharging formation surface in traveling relatively in the parallel direction to the traveling direction of the aforesaid recording head to scan, and a supporting member installing therein a recording head provided with one cavity which is larger than the size of the aforesaid discharging port in the traveling course of the cleaning member on the discharging port formation surface to be cleaned by the aforesaid cleaning member and in the upstream of the ink discharging port formation area in the aforesaid traveling direction.

BRIEF DESCRIPTION OF THE DRAWINGS

FIG. 17 is a timing chart illustrating the sequence of the preliminary discharging or suction recovering process according to the present embodiment;

DETAILED DESCRIPTION OF THE PREFERRED EMBODIMENTS

Hereinafter, in reference to the accompanying drawings the embodiments of the present invention will be described in detail.

Figure 1:
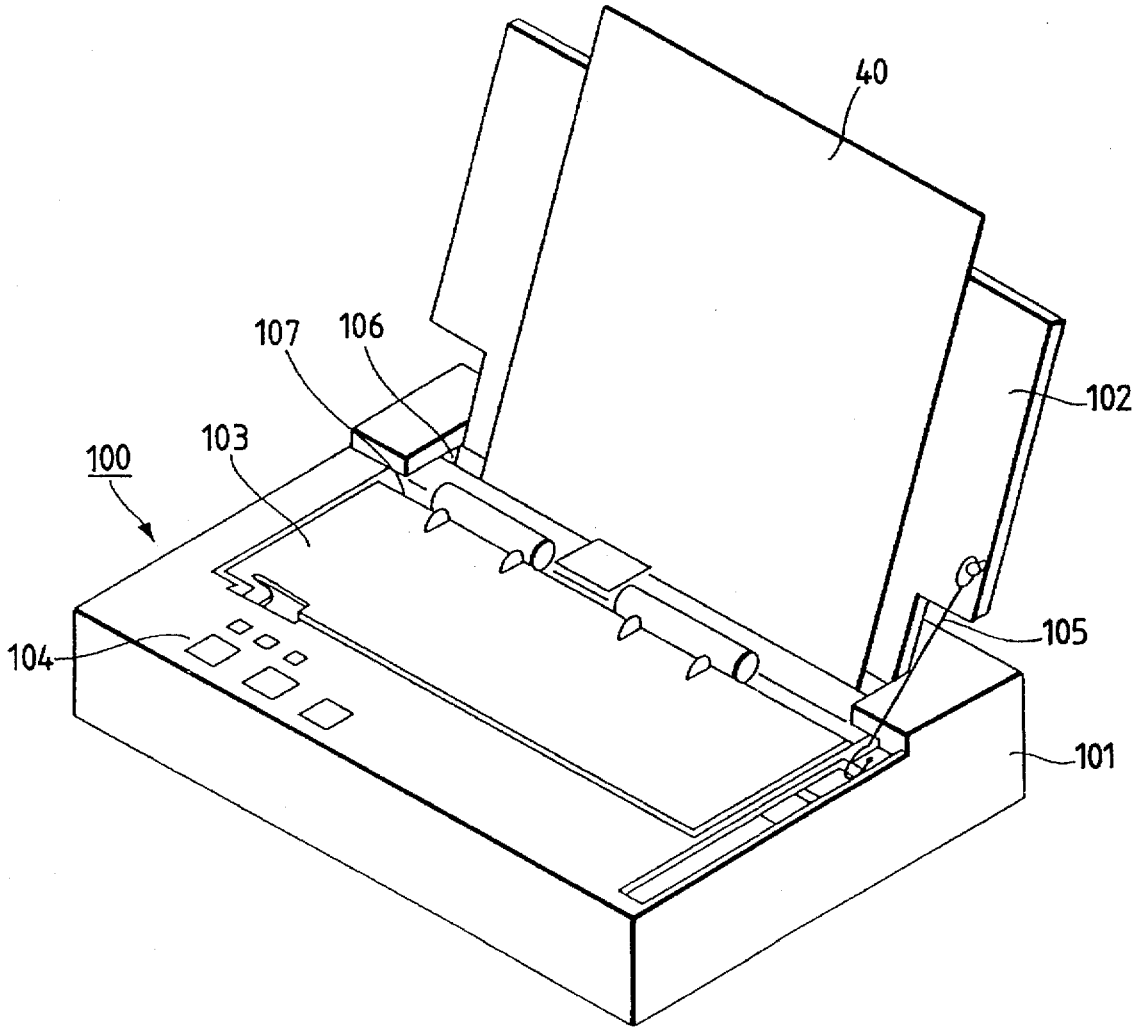
FIG. 1 is an externally perspective view showing an embodiment of the ink jet recording apparatus according to the present invention.
Figure 2:
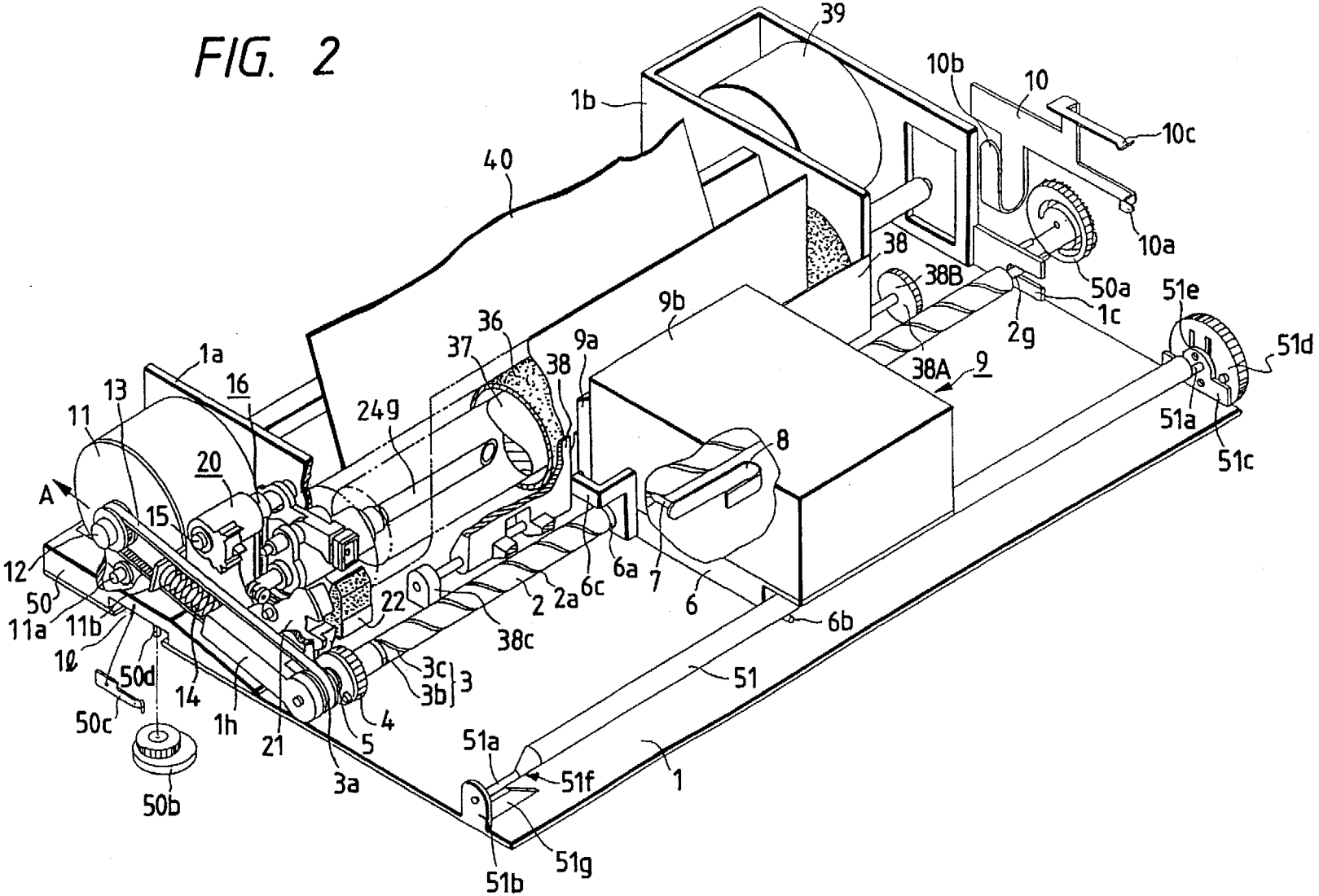
FIG. 2 is a perspective view showing the principal part of the recording apparatus shown in FIG. 1 without its cover.
Figure 3A:
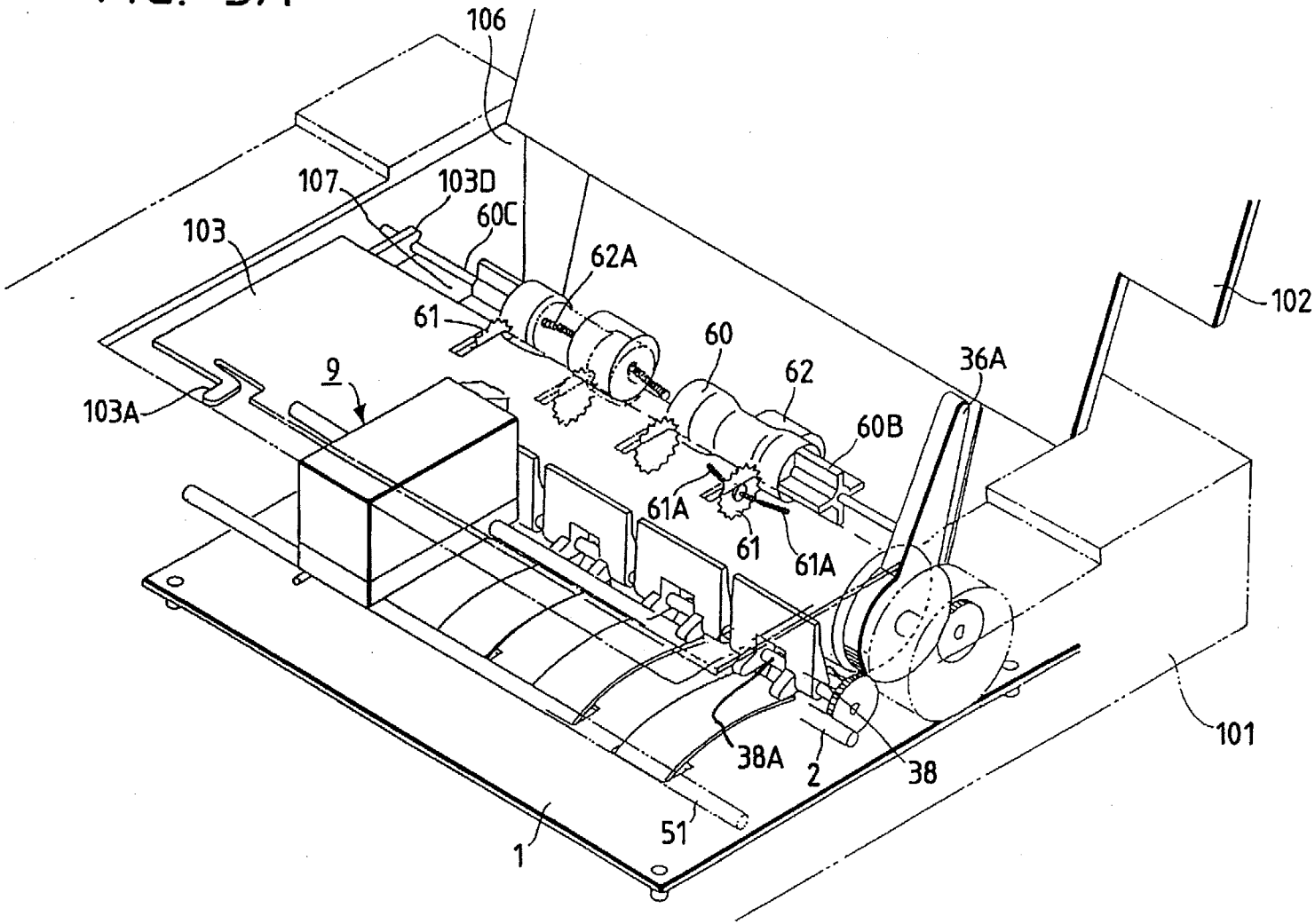
FIG. 3A is a perspective view showing mainly the paper exhausting system of the recording apparatus shown in FIG. 1.
Figure 3B:
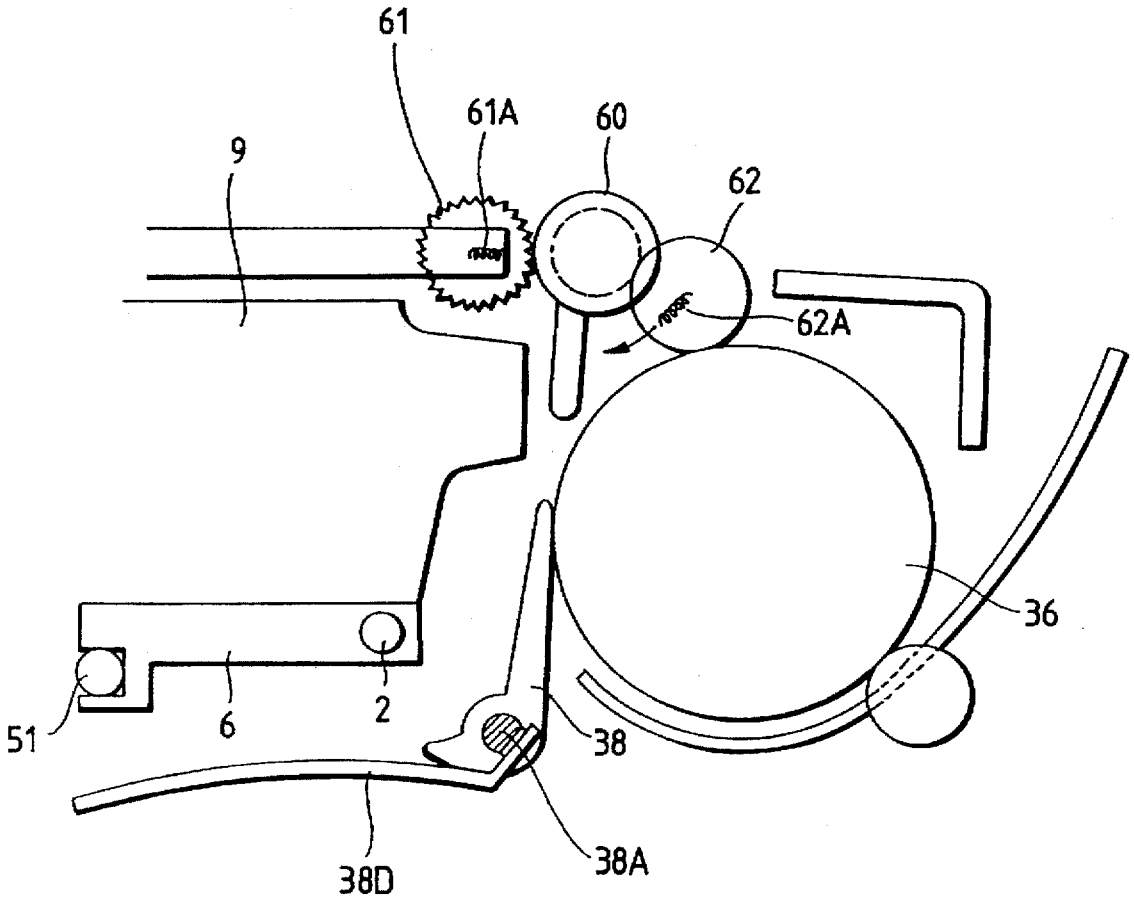
FIG. 3B is a side view of the system shown in FIG. 3A.

FIG. 1 is an externally perspective view showing an embodiment of the ink jet recording apparatus according to the present invention, FIG. 2 is a perspective view showing the principal part of the recording apparatus shown in FIG. 1 without its cover, FIG. 3A and FIG. 3B are both perspective views showing mainly the paper exhausting system of the recording apparatus shown in FIG. 1.

In FIG. 1, a reference numeral 100 designates a ink jet recording apparatus. This recording apparatus 100 is mounted for use as shown in FIG. 1 or mounted vertically for use as described later, and is comparatively small in size.

A reference numeral 101 designates a recording apparatus case; 102, a outer cover; and 103, an inner cover. When the recording apparatus is not in use, the outer cover 102 is overrupted with the inner cover 103 to make the recording apparatus 100 compact. Hence it may be possible for the user thereof to carry the recording apparatus in a portable back dedicated thereto, for example.

Also, the outer cover 102 can be used dually as a paper feeding guide for the recording sheet 40 as shown in FIG. 1. In this case, the portion designated by a reference numeral 106 in FIG. 1 serves as the paper feeding inlet. Further, the outer cover 102 can be used dually as an exhausting paper tray as described later.

In either of the above cases, the portion designated by a reference numeral 107 serves as an exhausting paper outlet.

A reference numeral 105 designates a position fixing hook for the outer cover 102; and 104, operation keys, display portion, and the like.

Now, in reference to FIG. 2, the structure of the principal part of the recording apparatus will described.

In FIG. 2, a reference numeral 1 designates the chassis on which the left-hand side plate 1*a* and the right-hand side plate 1*b* serving dually as guide for a recording medium such as paper are vertically fixed on the rear portion thereof. Also, on the chassis 1, there is provided a motor mounting hole for supporting rotatively the carrier motor, which will be described later, though omitted to be shown in FIG. 2.

A reference numeral 1*h* designates a lead arm which supports a lead screw, which will be described later, in the axial direction and radial direction. The lead arm is supported by the bearing portion which is not shown in FIG. 2.

A reference numeral 2 designates the lead screw, and a lead groove 2*a* is formed by a predetermined pitch facing the recording range. Also, on the carrier home position side of the lead screw 2, the position groove 3*b* for defining the position for performing the capping and recovery discharging is formed on the circumference of the vertical cross-section of the screw shaft. Further, the lead groove 2*a* and position groove 3*b* are smoothly connected by an induction groove 3*c*.

On the right-hand end of the lead screw 2, a shaft 2*g* is provided and at the same time, on the left-hand end thereof, another shaft is provided, and are respectively inserted into the bearing portions provided on the front side plate 1*c* and lead arm 1*b* to be rotatively supported with respect thereto. A reference numeral 3 designates the lead pulley which is mounted on the shaft of the lead screw 2 including the above-mentioned grooves 3*b* and 3*c*, and at the leading end thereof, a pulley 3*a* is provided. Then, to this pulley 3*a*, the driving power of a motor 11 is transmitted through a timing belt 13.

Also, the shaft 2*g* on the right-hand end of the lead screw 2 is slidably fitted into the horizontal groove of the guide plate 1*c* which is connected to the right-hand plate 1*b* of the chassis and the chassis 1, and is pressed to the thrust direction by the pressure portion 10*a* of a flat spring 10 and at the same time, the shaft 2*g* is fitted into the cam groove of a cam groove plate 50*a* rotatively supported by a shaft arranged on the guide plate 1*c*. On the periphery of the cam groove plate 50*a*, engagement teeth are formed, and by the engagement of these teeth and the ratchet portion 10*c* of the flat spring 10, the cam groove plate 50*a* is latched to stop at a desired position. As a result, the position of the shaft 2*g* fitted into the cam groove in the horizontal groove of the guide plate 1*c* is defined; hence the position of the lead screw 2 at the right-hand end of the recording apparatus is established. This structure is used for the adjustment of the gap between the recording head and platen which will be described later.

A reference numeral 4 designates a clutch gear which is slidably supported in the axial direction with respect to the lead pulley 3, and is coupled in the rotational direction by the key portion of the lead pulley 3 which will be described later in conjunction with FIG. 11. Thus the rotational force of the lead screw 2 is transmitted to the clutch gear; and 5, a clutch spring which is a compression spring to cause the clutch gear 4 to be tensioned toward the lead groove. In this respect, a restrictive member is formed between the clutch gear 4 and lead pulley 3 so as to limit the traveling of the clutch gear 4 in the axial direction within a predetermined range.

A reference numeral 6 designates a carrier slidably mounted on the lead screw 2; 6*a*, a pressure portion to press the side of the clutch gear 4, which is formed integrally with the left-hand side of the carrier; 7, a lead pin fitted into the lead groove 2*a* of the lead screw 2, the pressing direction of which is guided by a guding hole (not shown) of the carrier 6; 8, a lead pin spring, one end of which is mounted on the carrier 6 to press the lead pin 7 by the other end thereof.

A reference numeral 9 designates the recording head mounted on the carrier 6 having, in the present embodiment, a cartridge mode attachable to or detachable from the carrier 6 with its head element 9*a* and ink tank 9*b* serving as its ink supply source integrally formed therewith. With this mode, the recording head 9 can be used as a disposable head which is replaceable when ink has been consumed or the like. In this respect, although an electrothermal converting element or electromechanical transducing element is used as the discharging energy generating element arranged in the head element 9*a* to enable the ink discharging energy to function, the former is preferably employed because with the former, it is possible to assemble the ink discharging ports and others with a higher density as well as to simplify the manufacturing processes.

A reference numeral 6*c* is the hook fixed on a part of the carrier 6, which is a mechanism used to enable the recording head 9 to be stopped with steadiness at the capping position or the like when the carrier 6 travels as described later.

A reference numeral 51 designates a carrier guide shaft fitted slidably into a guide pin 6*b* provided at the rear end of the carrier 6. The guide shaft 51 has eccentric shafts 51*a* as described later in conjunction with FIG. 4, and these shafts 51*a* are rotatively supported by the side plates 51*b* and 51*c* provided at the ends of the chassis 1. Further, the leading end of the shaft 51*a* supported by the side plate 51*c* is fixed by a position setting knob 51*d*, and the rotational position of the shaft 51 is set by coupling the projection provided on the knob 51*d* and the hole 51*e* provided on the side plate 51*c*.

Figure 4A:
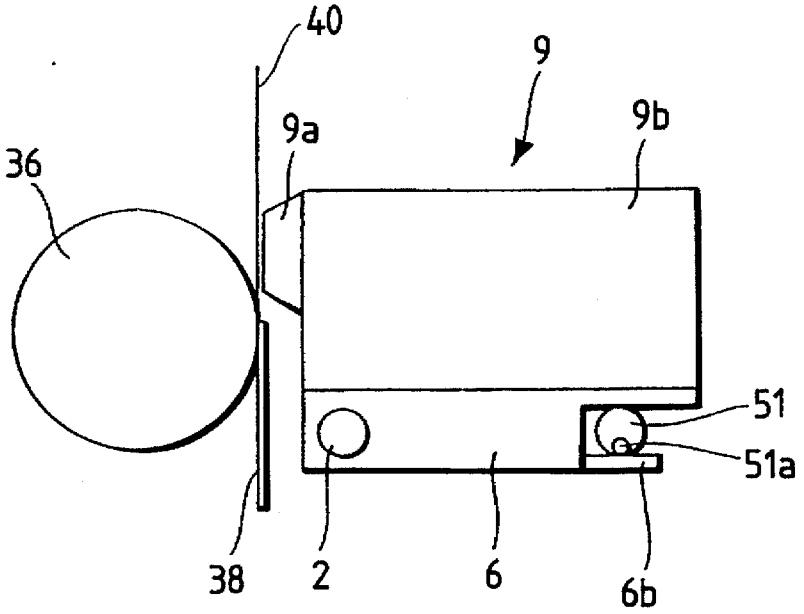
FIGS. 4A and 4B are side views showing an example of the recording head embodying the present invention with respect to a recording sheet respectively.
Figure 4B:
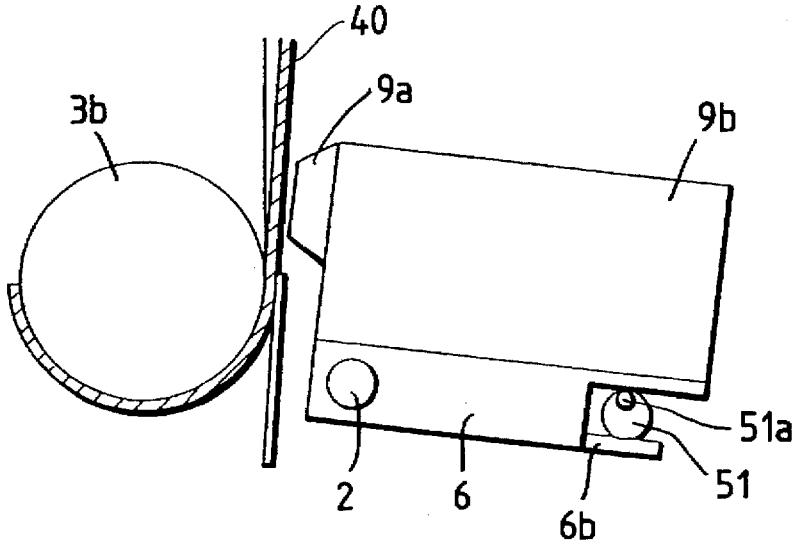

As shown in FIG. 4A and FIG. 4B, the above-mentioned structure is arranged to make the space between the recording surface of the recording paper 40 and the discharging port of the head element 9*a* appropriate depending on the kind of recording paper 40. In other words, by rotating the knob 51*d* manually, the shaft 51 can be fixed at a position where the distance between the shaft 51*a* and pin 6*b* is minimum as shown in FIG. 4A or maximum as shown in FIG. 4B. Accordingly, the recording head 9 is rotated with the lead screw 2 as its rotational axis to be fixed at a position suited for the recording paper 40 which is a comparatively thin ordinary paper (FIG. 4A) or at a position having a large space (FIG. 4B) suited for a comparatively thick recording paper such as an envelope.

Figure 5A:
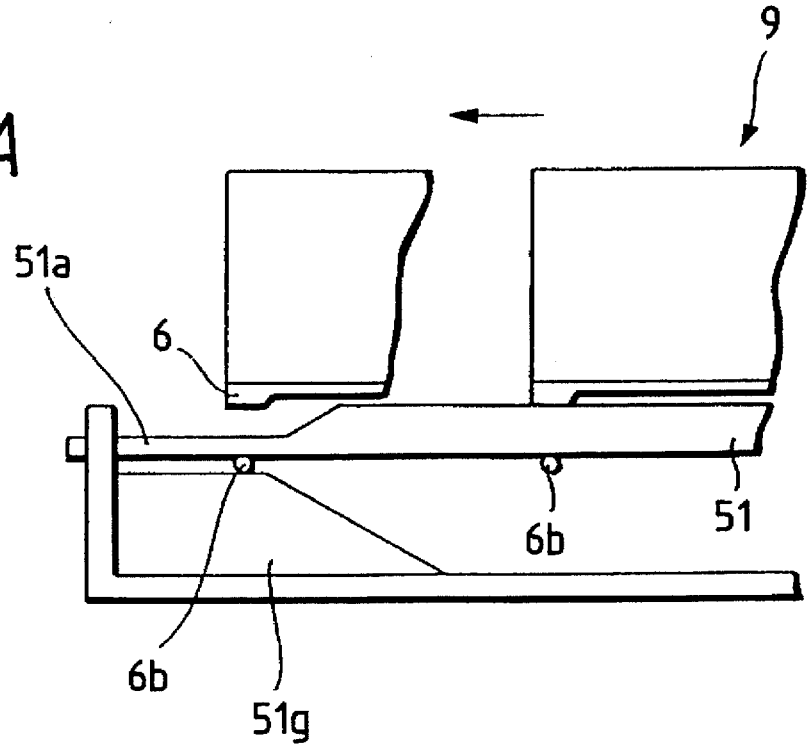
FIGS. 5A and 5B are rear views showing an example of the recording head embodying the present invention with respect to a recording sheet respectively at its home position.
Figure 5B:
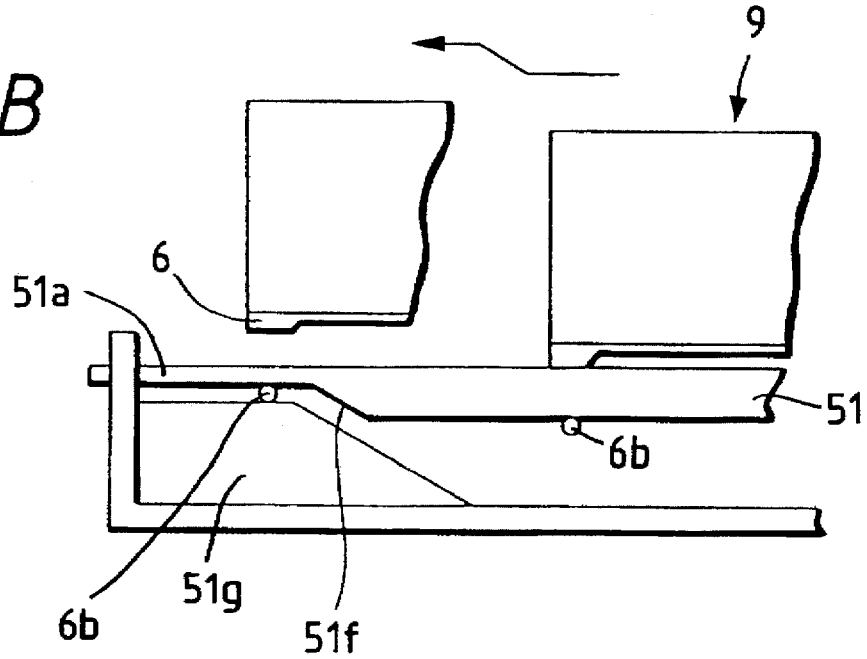

However, the above mentioned structure is a structure suited for the recording papers at the time of recording. In other words, the recording head 9 is traveled to the position where the recovery processing system is provided, which is shown at the left-hand side of FIG. 2, at the time of discharging recovery process. At this juncture, the recording head 9 and recovering system should maintain a predetermined positional relationship at all times. Therefore, it is necessary for the recording head 9 to be fixed at a predetermined position when the discharging recovery process is executed irrespective of the position shown in FIG. 4A or FIG. 4B at the time of its recording. FIG. 5A and FIG. 5B illustrate the structure needed for such purpose.

FIG. 5A and FIG. 5B are views respectively corresponding to FIG. 4A and FIG. 4B.

In the case of FIG. 5A, the shaft 51*a* and pin 6*b* can be connected without changing the height of the connecting position of the shaft 51 and pin 6*b*. At this juncture, in order to maintain the height of the contacting position, the parallel plane of the staged cam 51*g* is also allowed to be connected with the pin 6*b*.

In the case of FIG. 5B, when the recording head 9 is traveled so as to allow the pin 6*b* to be connected with the shaft 51*a*, the height of the connecting position of the pin 6*b* is changed. To this end, a taper portion 51*f* is provided for the shaft 51, and a tapering face is provided on the staged cam 51*g* to match therewith. Thus, such height is maintained accompanying the changes in the height of the connecting position of the pin 6*b* to the shaft 51 (taper portion 51*f*, shaft 51*a*).

With the above-mentioned structure, it is possible to maintain a predetermined height when the recording head 9 has arrived at the position of the discharging recovery system, i.e., to keep a predetermined positional relationship with the recovery system.

In this respect, the position for the recording head 9 to fix its rotation is not limited to the above-mentioned two, and it may be possible to fix the recording head at intermediate positions to match itself with recording papers of various thicknesses. In such a case, the connecting positions between the projection of the knob 51*d* and the hole 51*e* of the side plate 51*c* should be provided more.

Also, the rotation of the knob 51*d* is not limited to the manual operation, and it may be possible, for example, to rotate the knob 51*d* using the driving power of the paper feeding motor and the like by a key input with respect to the kind of recording paper to be used.

Now, reverting to FIG. 2, a reference numeral 11 designates a carrier motor which can be a pulse motor, for example. At the lower part of the front and rear faces thereof, a rotational pin 11*a* is provided in a state of being aligned, and these rotational pins 11*a* (one on the rear face side is not shown) are rotatively mounted in the motor mounting hole provided on the recovering system base 50 which is movable on the chassis 1. The rotational pins can be provided on the recovering system base 50 while the mounting hole, on the motor side as a matter of course. Then, the carrier motor 11 is rotatively mounted with the rotational pins 11*a* as its center; 11*b*, a spring bracket formed integrally with the carrier motor 11 and vertically provided in parallel to the motor shaft to receive the motor spring 14 which will be described later. Then, on the spring bracket, a column shape projection is formed, to which the end of the coiled motor spring 14 is fixed.

A reference numeral 12 designates a motor pulley fixed on the motor shaft of the carrier motor 11; and 13, the timing belt tensioned between the motor pulley 12 and a pulley 3*a* mounted on the shaft of the lead screw 2. The motor spring 14 is a compression spring in the structure of the present embodiment, and is mounted between one end of the lead arm 1*h* and the spring bracket 11*b* of the carrier motor 11 thereby to allow the carrier motor 11 to be tensioned in the direction indicated by arrow A in FIG. 2 to give tension to the timing belt 13 accordingly.

A reference numeral 15 designates a setting shaft projectingly mounted on a side plate (not shown) fixed on the base 50 to install means for conditioning the discharging port formation surface, cap, and the so-called recovering system mechanism related to the discharging recovery are mounted thereon.

Here, as described earlier, the positional relationship between this recovering system mechanism and recording head 9 is important. For example, in order to optimize the function of the blade to wipe the discharging surface of the recording head 9, the relationship between the blade and the discharging port surface is important. Also, in order to optimize the capping function for the discharging port surface, the space between the cap and the discharging port surface is important. Therefore, it is desirable to maintain the positional relationship between the recovering system mechanism and the recording head 9 constant at all times.

On the other hand, the recording head 9 is caused to travel along the lead screw 2 by the driving force transmitted thereto through the lead screw 2 to perform the recording. At this juncture, it is readily understandable than the distance between the recording paper 40 and the discharging port of the recording head 9 should desirably be the same at any positions in the course of the traveling. Therefore, an adjustment mechanism may be provided to adjust the distance from the recording head 9 to the recording paper so that the recording head 9 can be traveled in parallel to the recording paper. However, such an adjustment may hinder the constant positional relationship with the recovery system mentioned above.

In the present embodiment, therefore, the recovering system base 50 with the carrier motor 11 and the recovering system mechanism, which will be described later, installed thereon is arranged movable with respect to the chassis 1. With the traveling of this base 50 and the adjustment by the aforesaid cam groove plate 50*a*, the position of the lead screw 2 is adjusted at its both ends so as to allow the recording head 9 to travel in parallel to the recording paper 40. The details of such mechanism for the base 50 are shown in FIG. 6.

Figure 6:
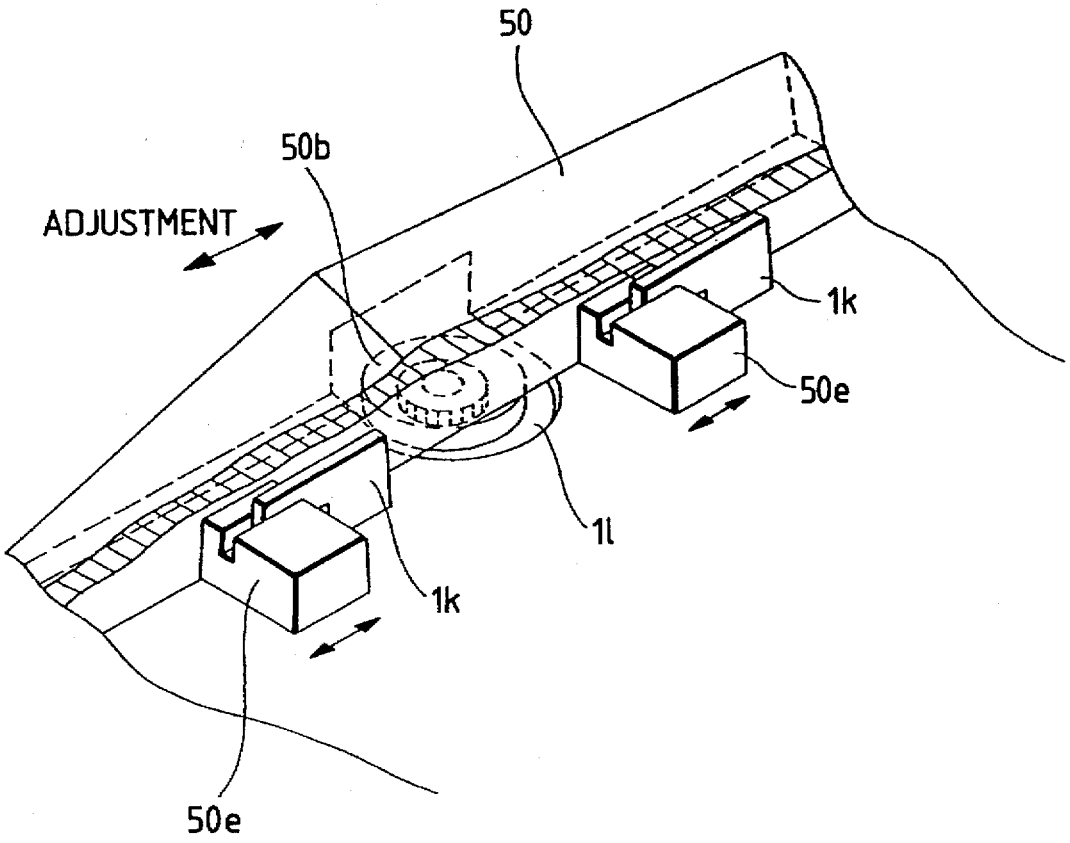
FIG. 6 is a partially cutaway perspective view showing an example of the base with the recovering system mechanism mounted thereon embodying the present invention in a state where the mechanism engages with the chassis.

FIG. 6 is a partially cutaway perspective view of the recovering system base 50 observed in the direction opposite to FIG. 2.

In FIG. 6, a reference numeral 50*e* designates a guide groove member fixed to the side of the groove provided on the reverse face side of the base 50. By engaging the groove of this member 50*e* with the guide portion of the hook type guide member 1*k* fixed on the chassis 1, the traveling direction of the base 50 is restricted, and the base 50 is prevented from being lifted from the chassis 1.

In the above-mentioned structure, the cam plate 50*b* is rotated around the shaft 50*d* mounted on the base 50 as shown in FIG. 2 in detail to cause the cam face thereof to be in contact with either one of the cam grooves 11 of the chassis 1 to press that face. Then, the base 50 is caused to travel in the direction guided by the member 50*e* and member 1*k* due to the reaction force of such pressure.

In this respect, the above-mentioned cam construction may be arranged in such a manner that a cam plate is rotated around a specific shaft by operating a shaft which is fitted into a specific cam groove formed on the cam plate.

Accompanying this traveling, the position of one end of the lead screw 2 is adjusted while the carrier motor 11 and the driving system for driving the motor 11 mounted on the base 50 (i.e., the timing belt 13, pulleys 3 and 12, lead screw 2 and the like) as well as the recovering system mechansim also mounted on the base 50 are allowed to travel all together.

In the meantime, the positional adjustment of the other end of the lead screw 2 is performed by rotating the cam plate 50*a*.

With the above-mentioned adjustment, the lead screw 2 can be placed in parallel with the recording paper thereby to allow the recording head to travel in parallel to the recording paper.

In this respect, this adjustment is performed by an assembling robot in the course of the manufaturing processes, but is may be possible to do this adjustment on the user's side at the time of repairing after a long time use of the recording apparatus, for example.

Subsequently, in reference to FIG. 2 and FIGS. 7A through 7C, means for optimizing the discharging port formation surface, which is one of the recovering system mechanisms, will be described.

A reference numeral 16 designates a blade lever (refer to FIG. 7A), and the boss portion 16*a* is rotatively mounted on the set shaft 15; 16*b*, the arm portion; 16*c*, the hook portion; and 17, a blade for wiping the discharging port formation surface, which is made of silicon rubber, chloroprene (CR) rubber or other resilient materials. A reference numeral 18 designates the blade shaft to clamp the blade 17 by its center portion in parallel to the rotational shaft, which is rotatively mounted on the blade lever 16; also 18*a*, a rotational piece to be formed integrally with the blade shaft 18; 19, an ink carrier formed by a hydrophilic porous material (plastic sintered compact, urethane foam, or the like), which is fixed to the blade lever 16. In this respect, the blade 17 and ink carrier 19 are arranged at the position overlapping with the cap which will be described later.

A reference numeral 20 designates a setting lever rotatively mounted on the setting shaft 15; 20*a* and 20*b*, stopping teeth provided for the setting lever 20; 20*c*, a starting tooth arranged likewise; and 20*d*, also a rotating tooth. The thickness of the starting tooth 20*c* is approximately half of those of the others. A reference numeral 20*e* designates the arm portion and by cutting a part thereof in the direction of the plate thickness, the setting face 20*f* and resetting face 20*g* are formed. Then, the rotational piece 18*a* of the blade shaft 18 mounted on the blade lever 16 is fitted into the cutaway part of the arm portion in the direction of the plate thickness to be combined to drive the arm portion.

A reference numeral 21 designates a timing gear rotatively mounted on the base 50 by a supporting member (not shown).

Figure 7A:
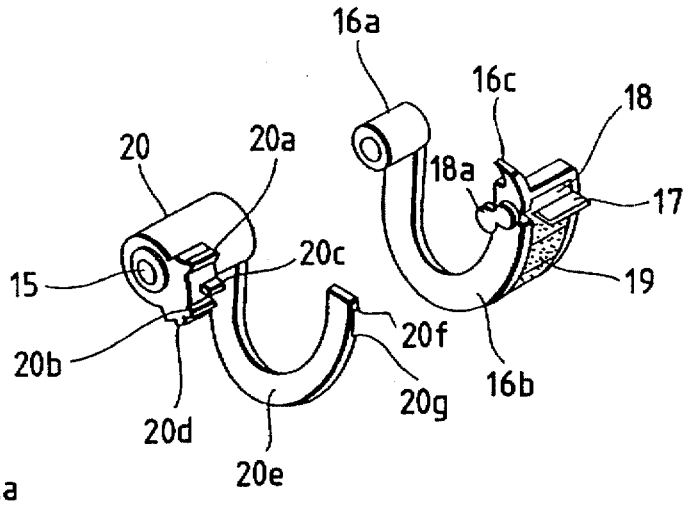
FIGS. 7A through 7C are partially perspective views showing the blade and ink carrier portions embodying the present invention with respect to the recording head.
Figure 7B:
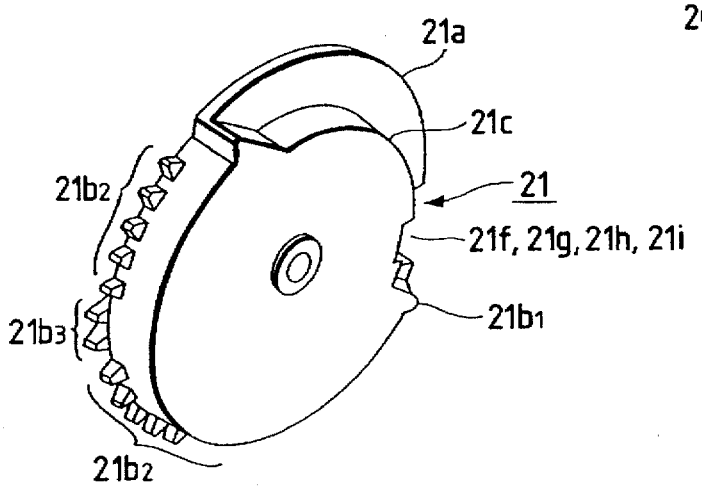

On a part of the outer periphery of the timing gear 21, a stopping cam 21*a* is formed as shown in FIG. 7B to engage with the stopping teeth 20*a* and 20*b* of the above-mentioned setting lever 20. Also, in the timing gear 21, three kinds of gears $21b_1$, $21b_2$, and $21b_3$ are formed each with a part of teeth being removed, and further, a capping cam 21*c* is formed at a predetermined position to oscillate a capping lever which will be described later. In addition, a piston set cam 21*f* is formed at a face cam on the timing gear 21 to press the piston of the pump which will be described later. Also, a piston reset cam 21*g* is integrally formed with a predetermined space with respect to the piston set cam 21*f*.

Figure 7C:
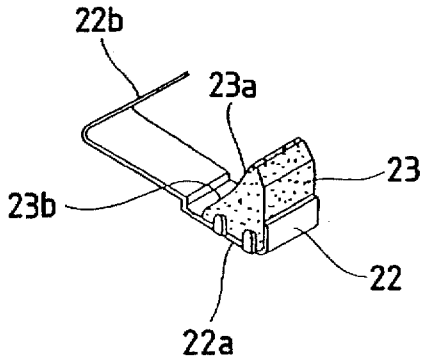

A reference numeral 22 designates an ink absorbent spring fixed at a predetermined position on the base 50, having, as shown in FIG. 7C, an absorbent supporting portion 22*a* and a spring portion 22*b* for rotating the pump which will be described later; and 23, an ink absorbent formed by the hydrophilic porous material the same as the aforesaid ink carrier 19. In this ink absorbent 23, a wiper portion 23*a*, with which the aforesaid blade 17 is in contact, is formed, and further, at the lower part thereof, an absorbing face 23*b* is formed to receive ink from the aforesaid ink carrier 19 when the carrier contacts with this face. In this respect, the absorbent supporting portion of the ink absorbent spring 22 is tensioned upward with a slight resiliency and is held by a stopper (not shown) at a predetermined position. Accordingly, when the aforesaid ink carrier 19 contacts with this portion, the ink absorbent 23 causes the ink absorbent spring 22 to be displaced downward to obtain a contacting state reliably.

Now, in reference mainly to FIG. 8 and FIG. 9, the recovery system unit, which is one of the recovering system mechanisms, will be described.

Figure 8:
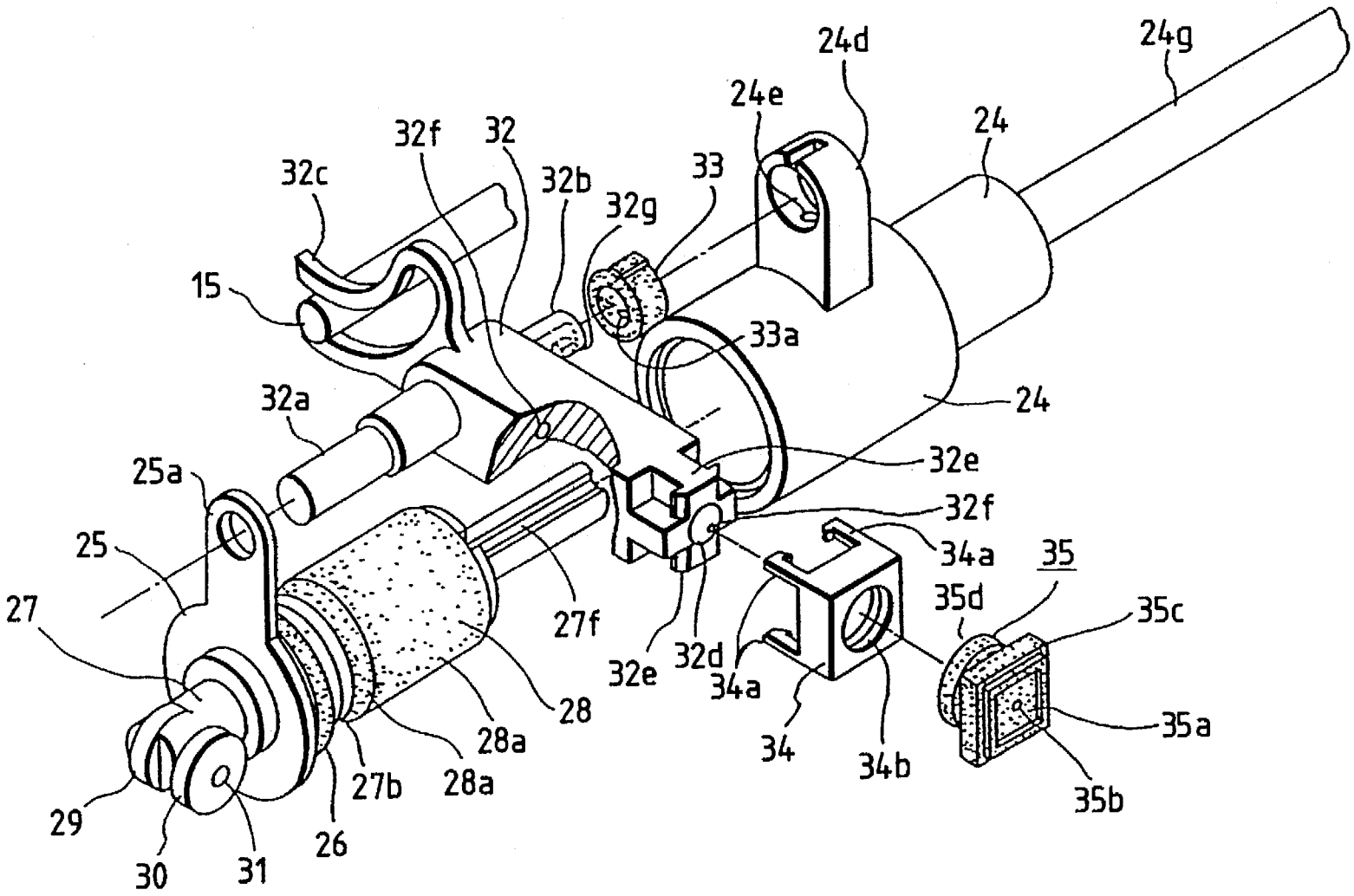
FIGS. 8 and 9 are an exploded perspective view and a cross-sectional view respectively showing the suction recovering system embodying the present invention with respect to the recording head.
Figure 9:
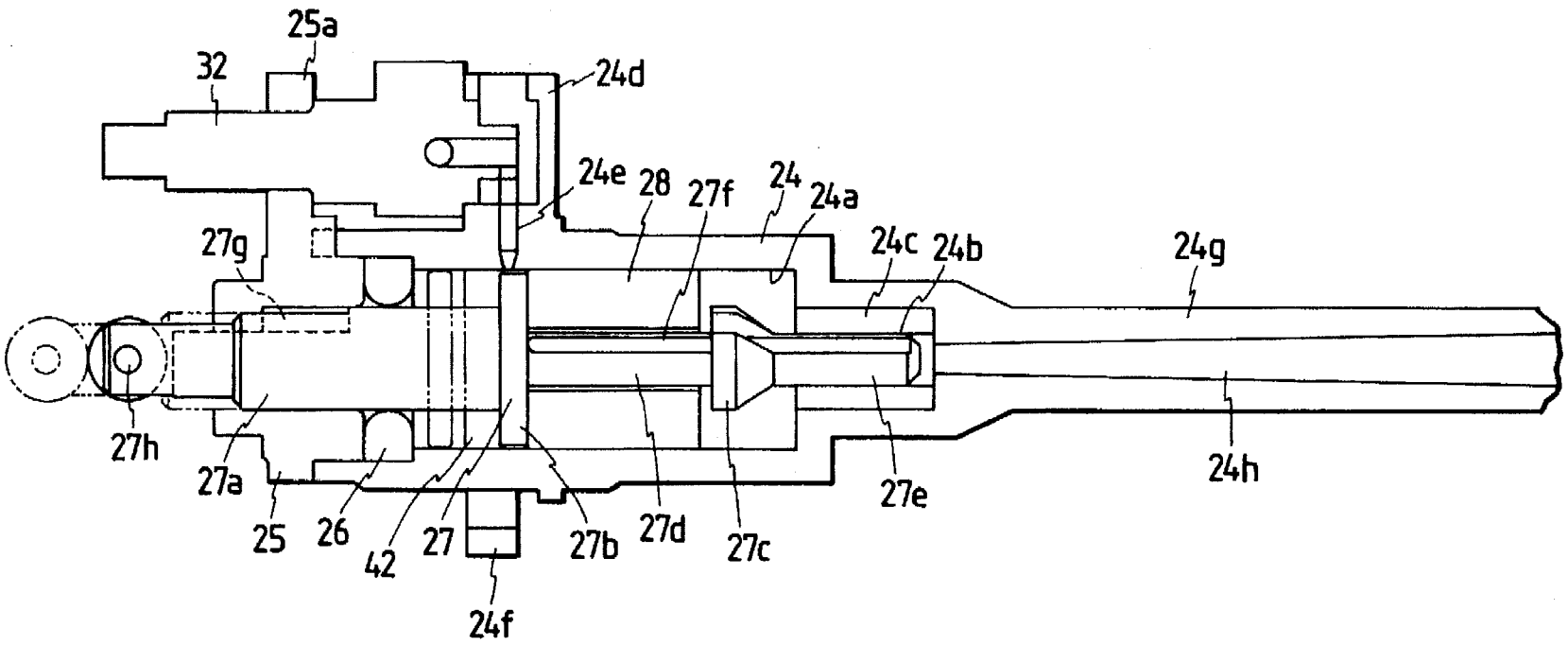

In FIG. 8 and FIG. 9, a reference numeral 24 designates a cylinder having a cylindrical cylinder portion 24*a* and a guide portion 24*b* for guiding the piston rod which will be described later.

In the guide portion 24*b*, an ink path 24*c* is provided by cutting away a part thereof in the axial direction. A reference numeral 24*d* designates a capping lever bracket formed in such a manner that the lever seal, which will be described later, is inserted thereinto; also, 24*e*, an ink path having its opening at a predetermined position in the cylinder portion 24*a*; 24*f*, a rotational lever integrally formed with the cylinder 24, to which the rotational force is given by the spring portion 22*b* of the aforesaid ink absorbent spring 22; 24*g*, a waste ink tube integrally formed with the cylinder 24, at the same time, the leading end thereof being cut with an acute angle so as to be easily inserted into the waste ink absorbent which will be described later; and 24*h*, an ink path formed in the waste ink tube 24*g*.

A reference numeral 25 designates a cylinder cap pressed into the end of the cylinder 24; and 25*a*, a lever guide arranged at a position opposite to the cap lever bracket 24*d* of the cylinder 24.

A reference numeral 26 designates the piston seal which is inserted into the cylinder 24 in such a manner that its inner diameter is made slightly small to obtain a predetermined contacting force with respect to the piston rod which will be described later. Also, a lubrication coating may be given to the surface of the piston seal 26 so that the sliding force of the piston rod can be reduced.

A reference numeral 27 designates the piston rod which comprises an operating shaft 27*a*, piston bracket 27*b*, piston receiver 27*c* connecting rod 27*d*, and guide shaft 27*e*, and further in the piston rod 27, a groove 27*f* serving as an ink path is formed along the connecting rod 27*d* and guide shaft 27*e*; and 27*g*, a rotation stopper formed in the operating rod 27*a* as a groove. Also, on the side face of the operating rod 27*a*, a bearing portion 27*h* is provided.

A reference numeral 28 designates a piston, the inner layer thereof observed from the cylinder sliding portion, which is the main body thereof, being formed by a resilient porous material. As materials, although there are a foam having single open cells (sponge and the like) and continuous fine porous substance or the like which has continuous open cells, a continuous fine porous substance such as a chain foaming urethane foam is preferable.

Also, as the aforesaid porous substance having continuous open cells, a substance having a plurality of continuous open cells existing in the direction intersecting the direction of the resilient deformation may be applicable. Now, the outer diameter of the piston is made larger than the inner diameter of the cylinder 24 by a predetermined amount so that the piston is in a state of being pressed appropriately when inserted thereinto. Also, the outer surface 28*a* and end face 28*b* which contacts the piston bracket 27*b* of the piston rod 27 are arranged to allow the solid layer (skin film) to be positioned when the piston is produced by foam molding. Here, although the main body of the piston is made by a chain foaming material, the skin film does not allow liquid to pass it through connectively. Therefore, the air-tightness is kept to enable the piston 28 to function as required. In this respect, if the piston is not provided with any skin film, it may be possible to prepare an air tight film separately.

A reference numeral 42 designates a pump chamber; 29, a piston pressing roller rotatively mounted on the end of the piston rod 27; 30, a piston returning roller rotatively mounted likewise on the end of the piston rod 27; and 31, the shaft of these rollers (piston pressing roller 29 and piston returning roller 30).

A reference numeral 32 designates a capping lever which comprises a rotational shaft 32*a*, ink guide 32*b*, and lever guide 32*c*. Also, at the leading end of the capping lever 32, a spherically convex sealing face 32*d* is formed. Further, at the leading end of the capping lever 32, a coupling portion 32*e* is provided at a pair of upper and lower members, to which the nails of the cap holder, which will be described later, are coupled. In addition, the ink path 32*f* is opened to the leading end from the sealing face 32*d* through the inside of the lever and the enter of the ink guide 32*b* after being bent at right angles on the way. In the respect, a cutaway portion 32*g* is provided below the ink guide 32*b*.

A reference numeral 33 designates a lever seal pressed into the capping lever bracket 24*d* with the ink guide 32*b*; 33*a*, a connectively communicative hole to allow the cut-away portion 32*g* of the ink guide 32*b* to be connectively communicated with the ink path 24*c*.

A reference numeral 34 designates a cap holder provided at a position where the cap holder 34 allows the hook 34*a*, which engages with the coupling portion 32*e* of the capping lever 32, to face the coupling portion 32*e*; 34*b*, an opening for mounting the cap which will be described later.

A reference numeral 35 is a cap forming a capping portion 35*a* which functions dually as a usual air-tight cap for preventing the ink evaporation and as a suction cap for sucking ink. In the cap 35*a*, there is formed a suction inlet 35*b* opening in the direction to the cap holder 34 through the center of the cap 35.

A reference numeral 35*c* designates a flange portion serving as an off-position check when mounted on the cap holder 34. Also, on the flange portion 35*c*, a spherically concave cap seal portion 35*d* is formed with the same curvature as the seal face 32*d* of the capping lever 32, and when pressed to the capping lever 32, only the central opening is connectively communicated therewith and all other portions are sealed. Then, the seal portions (32*d* and 35*d*) being spherical, the equalizing function of the cap members is excellent so that even if there is a staged portion on the discharging port formation surface, such staged difference is absorbed immediately to keep a stable air-tight condition.

Now, again reverting to FIG. 2, a reference numeral 36 designates a paper feeding roller to convey a recording medium such as paper, which may be produced by coating resilient coating material (urethane resin, acrylic resin or the like) over the surface of an aluminum drawn tube, for example. Also, this roller 36 functions as a platen to regulate the recording surface of a recording medium with the outer periphery thereof and at the same time, the inside thereof functions as a waste ink reservoir; 37, a waste ink absorbent provided in the roller 36, having an excellent structure to absorb ink in the axial direction with a thin tube formed by a plastic such as vinyl chloride stuffed with an absorbent such as polyester fiber. In this respect, although the waste ink tube 24*g* of the cylinder 24 is inserted into the waste ink absorbent 37, the waste ink tube 24*g* is supported in the absorbent 37 to the extent that the tube does not hinder the movement of the recovering system mechanism when the mechanism travels accompanying the movement of the base 50. Also, the fiber of the absorbent material itself should desirably be resin, metal, or some other non-liquid absorption material, but it may have a slight property of liquid absorption.

A reference numeral 38 designates a paper pressure plate made of fluoro-resin, carbon fiber mixture, or the like, which is divided into four parts and mounted on the chassis 1 as shown in FIG. 3 in detail. Also, a shaft 38A for releasing the pressure of the paper pressure plate 38 is provided with a gear 38B mounted at one end, and the other end thereof is fitted into a bearing 38C which supports the shaft 38A. The bearing 38C is fixed to the chassis 1. In this respect, the gear 38B engages with the gear portion of a release lever but not shown in FIG. 2. A reference numeral 39 designates a paper feeding motor connected with the paper feeding roller 36 through a speed reducing mechanism of a predetermined ratio.

A reference numeral 40 designates a paper, film or other recording sheet.

Subsequently, the operation of the above-mentioned structure will be described.

At first, in the operation of a usual recording, the lead screw 2 is rotated by the rotation of the shaft of the carrier motor 11 through the timing belt 13, and the carrier 6 is allowed to scan along a recording paper 40 in the direction of printing column by the lead pin 7 fitted into the lead groove 2*a*. Here, the carrier motor 11 being tensioned by the motor spring 14, the timing belt 13 is always tensioned to make a desirable transmission possible.

When the carrier 6 moves, inertia is exerted when the movement begins and stops, but the weight of the carrier motor 11 absorbs this inertia so that the load applied to the motor spring 14 is rather small. Also, in conjunction with this spring, if an air damper, hydraulic damper, or the like is provided, the noise caused by the vibration of the rotor of the motor 11 is reduced when the carrier 6 is started or stopped. By selecting the weight of this motor, weight of the carrier portion, and the coefficient of the motor spring damper appropriately, it is possible to reduce the overshoot of the rotor and make its noise reduction possible.

Now, in reference to FIG. 10 through FIG. 16, the operation of the present embodiment at the non-recording time will be described.

Figure 10:
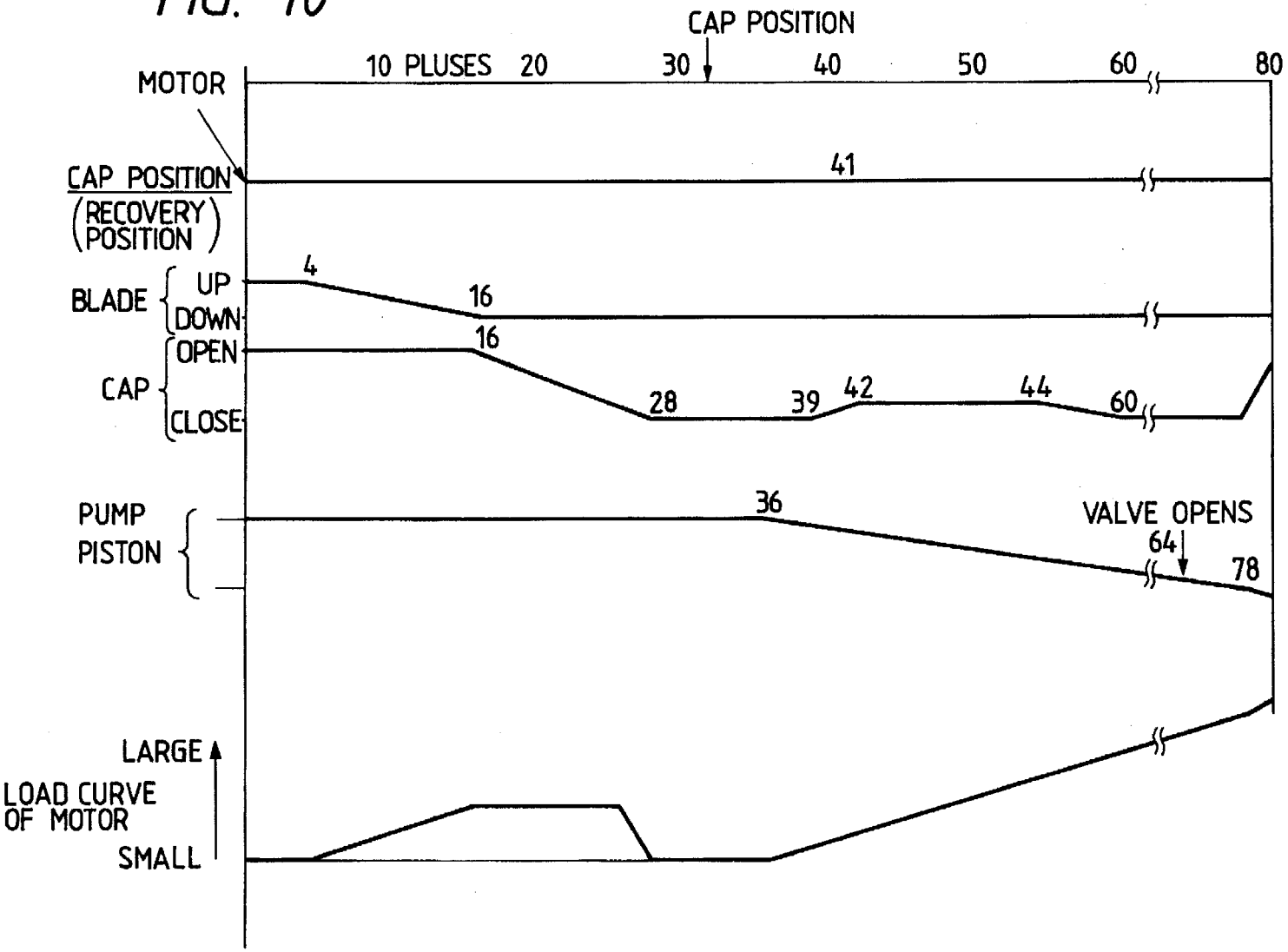
FIG. 10 is a timing chart showing the operating timing of each part of an embodiment according to the present invention.

FIG. 10 is a timing chart showing the timing of the movement of each part, and the timing of the movement of each part is defined by the pulses given to the motor 11 as shown in FIG. 10.

Figure 11:
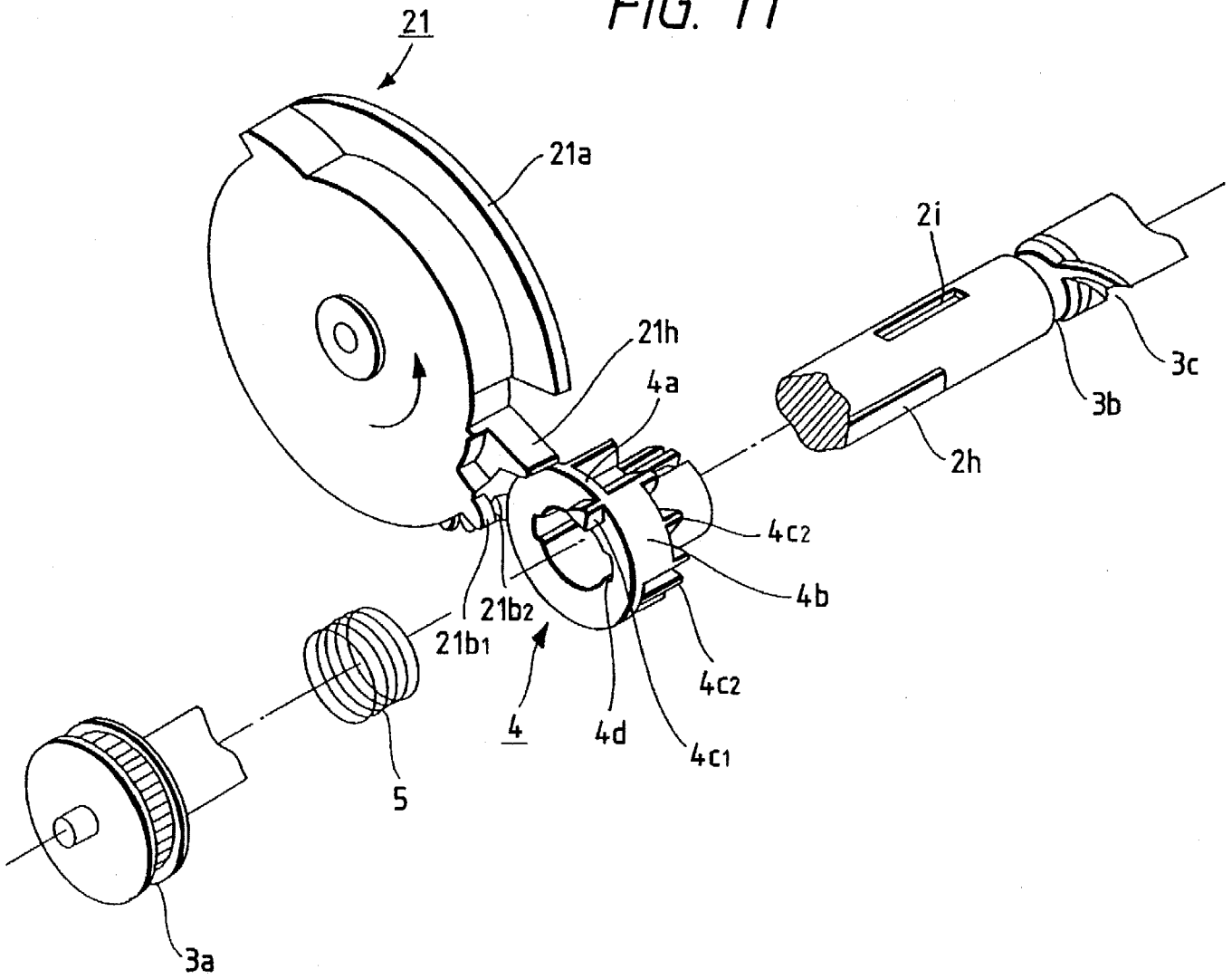
FIG. 11 is a perspective view showing an example of the clutch mechanism embodying the present invention for transmitting the driving force to the recovering system mechanism.

FIG. 11 is a perspective view showing the detailed structures of the above-mentioned clutch gear 4 and timing gear 21. The clutch gear 4 slides on the lead screw 2 and rotates therewith when its key way 4*d* and key portion 2*h* of the lead screw 2 are coupled. Also, the clutch gear 4 is tensioned in the direction toward the carrier 6 by the spring 5, and usually, placed at a predetermined position by the groove 2*i* of the lead screw 2 at the recording time and is rotated together with the lead screw 2. When the recording head is moved to the home position, the clutch gear 4 begins to engage with the timing gear 21 by being pressed by the carrier 6 accompanying such movement of the recording head 9.

The clutch gear 4 is provided with a starting tooth $4c_1$ and usual driving teeth $4c_2$, and the starting tooth $4c_1$ and driving teeth $4c_2$ are formed at different position in the width direction of the clutch gear 4. Also, the driving teeth $4c_2$ are not formed all around the periphery of the gear 4 in the same fashion, but there is provided partially a curbing face portion 4*b*. Further, at the end portion of the clutch gear 4, a flange 4*a* is formed all around its periphery.

The timing gear 21 is provided with a starting tooth $21b_1$ and two kinds of driving teeth $21b_2$ and $21b_3$ arranged at different positions as shown in FIG. 7B, and these teeth $21b_1$, $21b_2$, and $21b_3$ are formed at different positions in the width direction of the gear 21.

FIGS. 12A through 12C, FIG. 13A and FIG. 13B are views showing respectively a state of the clutch gear 4 and timing gear 21 engaging with each other.

Figure 12A:
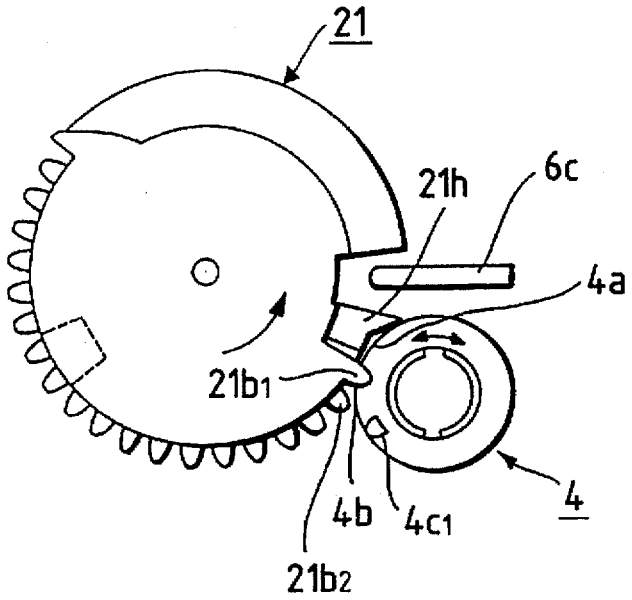
FIGS. 12A through 12C are side views showing the clutch gear and hook, and timing gear of the clutch mechanism shown in FIG. 11.
Figure 12B:
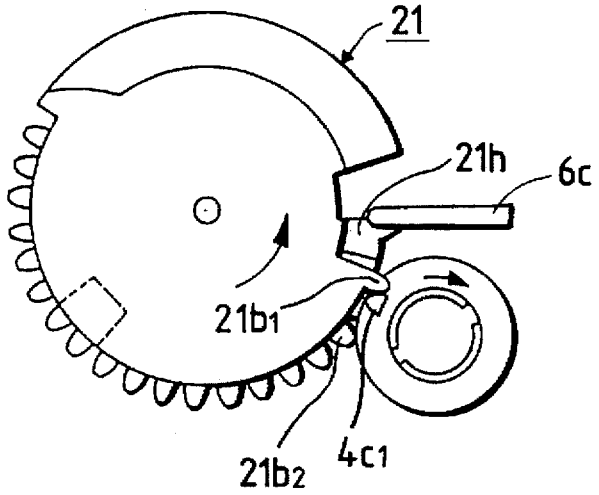
Figure 13A:
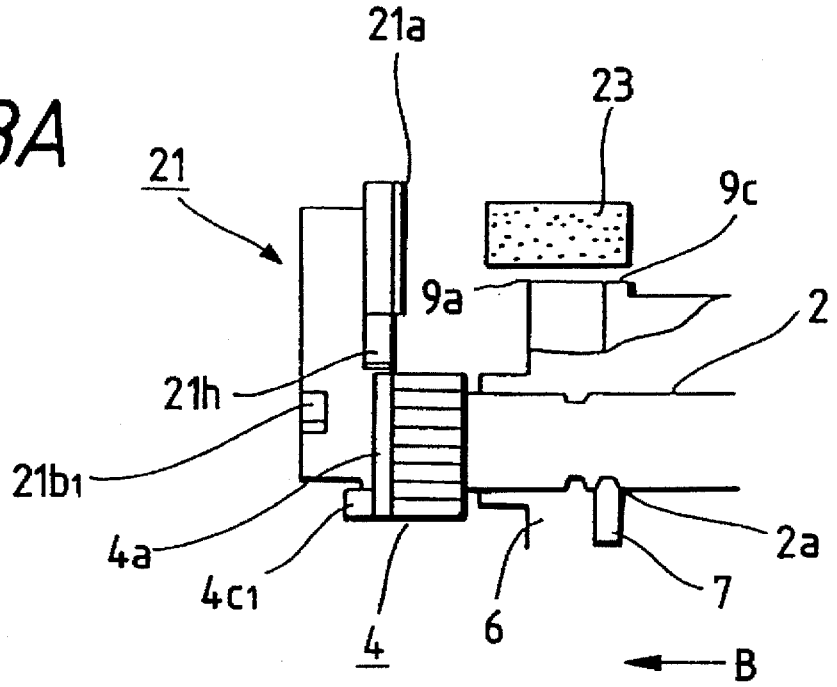
FIGS. 13A and 13B are plan views showing the same elements shown in FIG. 12A–12C.

At a usual recording time, these gears are in the states represented respectively by FIG. 12A and FIG. 13A. However, at this juncture, the lead pin 7 is not at the position in FIG. 13A. Also the blade 17 and ink carrier 19 are positioned above the ink absorbent 23 although not shown in FIG. 13A.

At this time, the clutch gear 4 is rotated accompanying the rotation of the lead screw 2, but the starting tooth $4c_1$ and starting tooth $21b_1$ are not in the positional relations to engage with each other (refer to FIG. 13A). As a result, the timing gear 21 is not rotated, and the driving teeth $21b_2$ and the flange 21*h* on the left end portion are in the positional relationship with the flange 4*a* of the clutch gear 4 with a slight space apart therefrom to allow them to be in contact therewith. Accordingly, the timing gear 21 cannot rotate in either direction.

In this way, the timing gear 21 is not allowed to rotate unnecessarily even if some rotational force should be given thereto or some force should be applied thereto manually; thus making it possible to prevent any error or the like from occurring in the operational position of the recovering system mechanism.

Figure 13B:
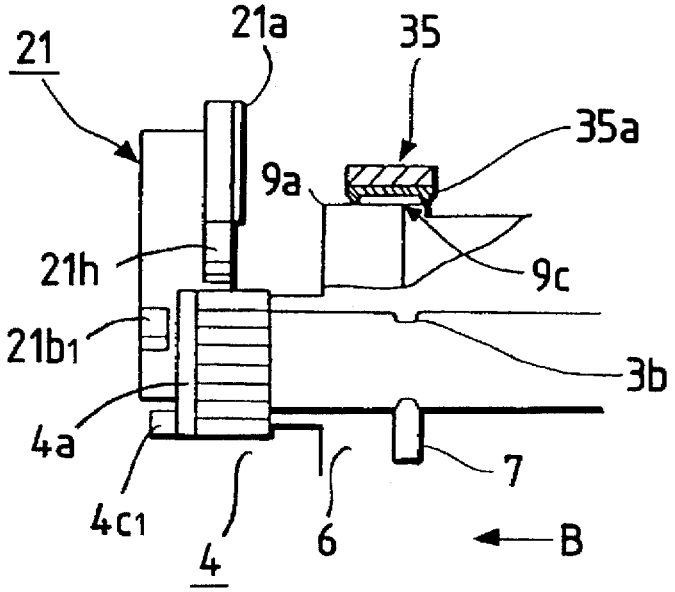

When the recording head 9 is moved in the direction toward its home position and the carrier 6 presses the clutch gear 4, the positional relationship between the clutch gear 4 and timing gear 21 becomes as shown in FIG. 13B ultimately. In this course of process, the starting teeth $4c_1$ and $21b_1$ are in the positional relationship which allows them to be engaged with each other; (however, the lead pin 7 has not been at this position as yet).

Figure 12C:
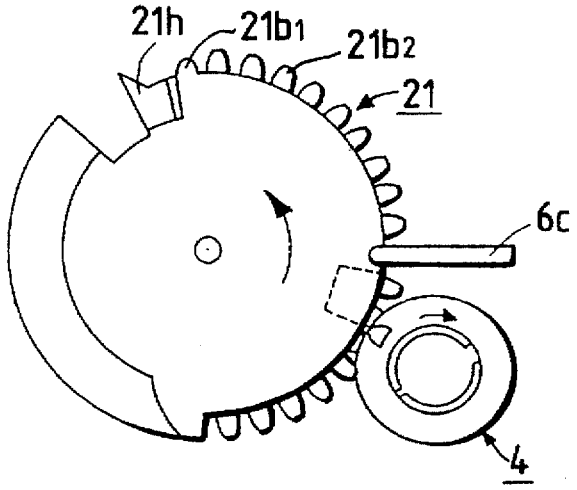

Subsequently, accompanying the movement of the lead pin 7 from the groove 3*c* to groove 3*b*, the clutch gear 4 rotates clockwise in FIG. 12, and the positional relationship changes from the state shown in FIG. 12A to that shown in FIG. 12C. At this juncture, until the starting teeth $4c_1$ and $21b_1$ have engaged with each other, the timing gear is not allowed to move unnecessarily so that the other driving teeth engage with each other first because the curbing portion 4*b* shown in FIG. 11 having no teeth is positioned to face closest to the timing gear 21.

Thus, the engagement of the clutch gear 4 and timing gear 21 always begins with the engagement of the starting teeth themselves. Therefore, the rotation of the timing gear 21 begins at the correct position all the times.

As a result, the operation of the recovering system mechanism driven through the timing gear 21 becomes accurate.

Also, there is an advantage obtainable that the installation precision required for the clutch gear 4 and timing gear 21 is not necessarily very high, and the like.

In this respect, the driving teeth $21b_3$ provided at a different position among the driving teeth of the timing gear 21 as shown in FIG. 7B are the driving teeth which perform its engagement when the above-mentioned curbing portion 4*b* again faces the timing gear 21. In other words, if these driving teeth $21b_3$ are positioned at the same position as the usual driving teeth $21b_2$, they are in contact with the curbing portion 4*b*. Therefore, the position of the driving teeth $21b_3$ is stepped behind so that the driving teeth $21b_3$ and driving gear $4c_2$ can be engaged while the curbing portion 4*b* and the driving teeth $21b_3$ are not allowed to be in contact with each other.

Also, while the timing gear 21 is rotating with the driving teeth themselves are in engagement, the hook 6*c* mounted on the carrier 6 slides the side face of the timing gear 21.

Thus, it is possible to prevent the recording head 9 from leaving its home position by, for example, the lead pin 7 having been caused to leave the groove 3*b* before the predetermined teeth are allowed to engage with each other. When the recording head 9 is at its home position and a series of the recovering processes are performed, the lead screw 2 rotates twice, and there is a possibility that the lead pin 7 is shifted into the groove 3*c*. Therefore, the above-mentioned arrangement is needed to prevent this from taking place beforehand.

In this respect, although the series of the recovering processes are performed by rotating the lead screw 2 twice in the above example, the rotation is not limited to this number, and it may be possible to set an arbitrary number of rotations thereby providing more freedom in designing the clutch mechanism and the like.

Figure 14A:
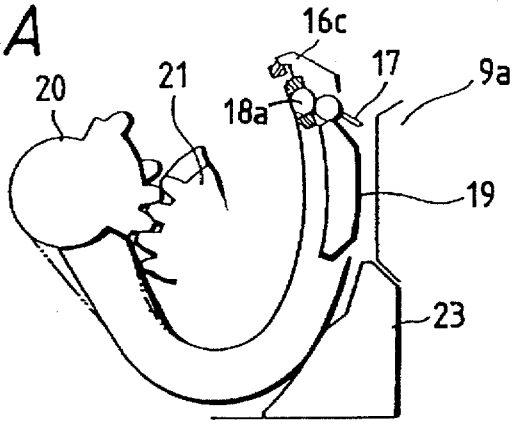
FIG. 14A through 14D are side views illustrating the sequential operation of the blade and ink carrier portions.
Figure 14B:
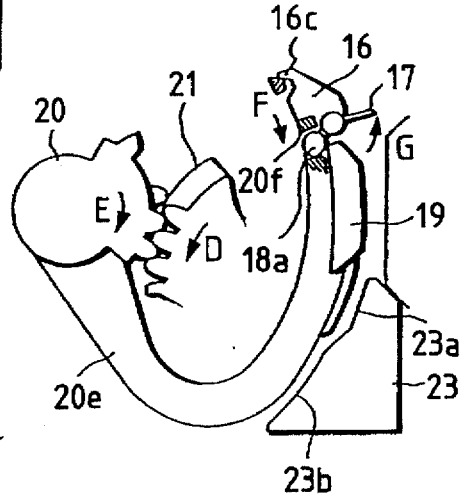
Figure 14C:
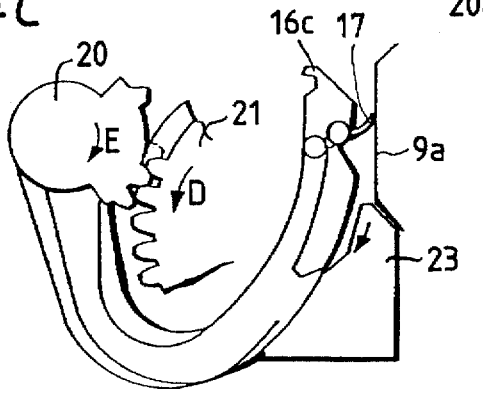
Figure 14D:
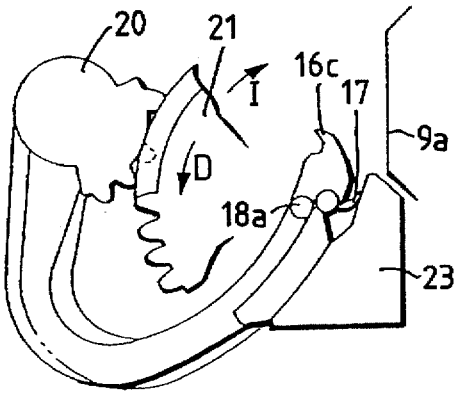
Figure 15A:
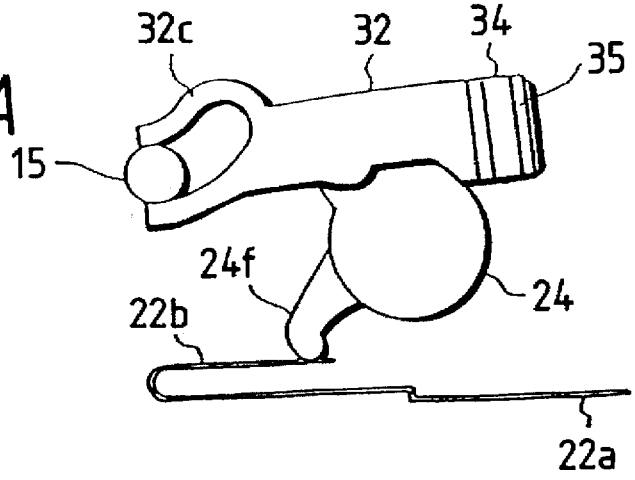
FIGS. 15A through 15C are side views illustrating the sequential operation of the cap portion.
Figure 15B:
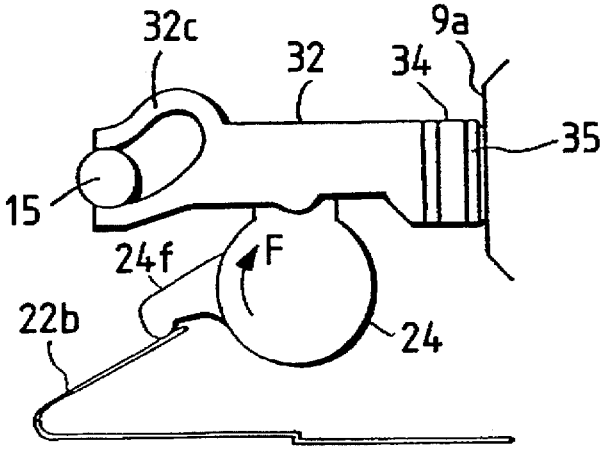
Figure 15C:
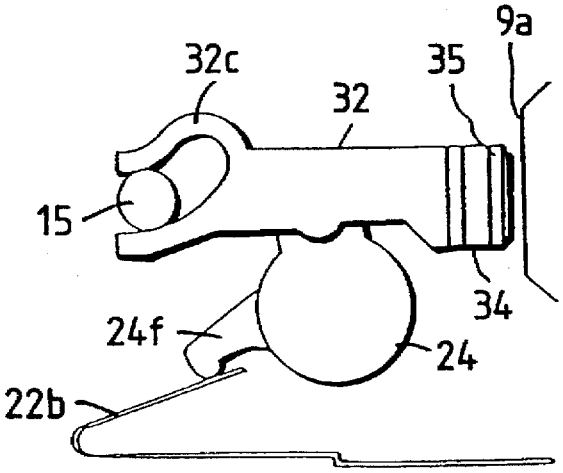
Figure 16A:
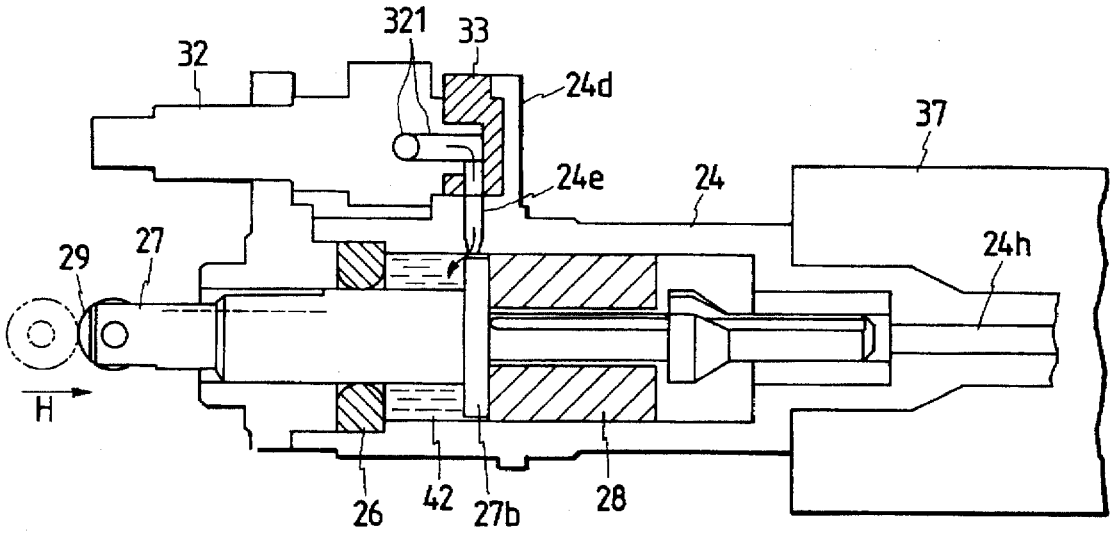
FIGS. 16A and 16B are cross-sectional side views illustrating the operation of the pump portion for performing the suction recovery.
Figure 16B:
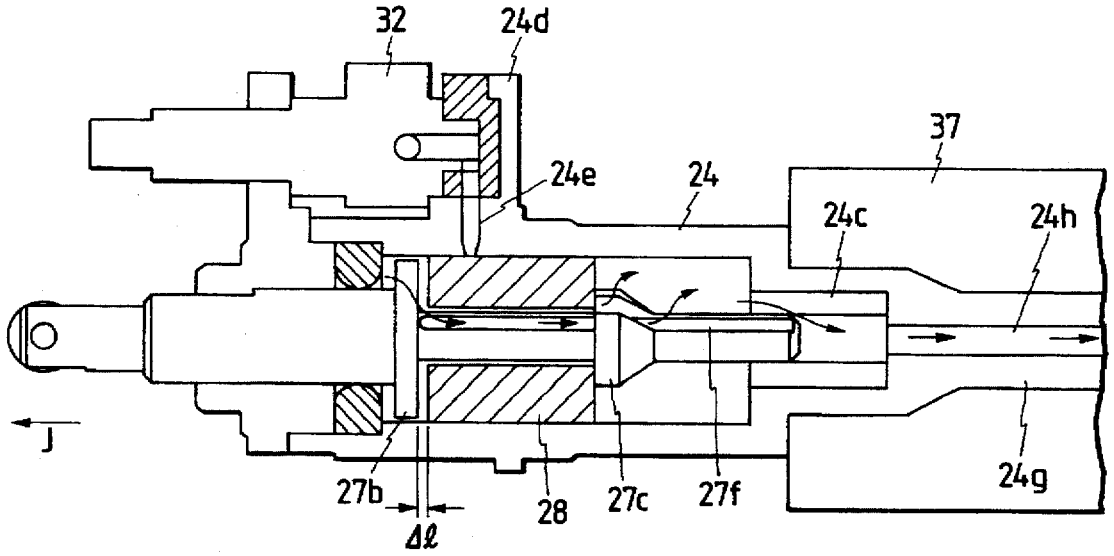

FIGS. 14A through 14D are views illustrating sequentially the operational state of the mechanism of the blade and others, FIGS. 15A through 15C are views illustrating sequentially the operational state of the mechanism of the cap 35, and FIG. 16A and 16B are views illustrating the operation of the mechanism for inducing waste ink into the waste ink reservoir 37 in the roller 36. Now, in reference with these FIGS. 14 through 16 and the above-mentioned FIG. 12 and FIG. 13, the respective operations will be described.

At first, the carrier 6 is allowed to move in the direction toward its home position (the direction indicated by arrow B). At this juncture, as shown in FIG. 13A, the lead pin 7 is fitted into the lead groove 2*a* and the discharging port 9*c* of the head element 9*a* is positioned to face the carrier 19 (refer to FIG. 14A). Here, at this position, the discharging operation is performed by driving all the discharging energy generating elements of the head element 9*a* (hereinafter referred to preliminary discharging) to discharge the ink which has slightly increased its viscousity and others by the discharging force. With this discharging, the recovery operation by the preliminary discharging is completed. Also, in order to prevent ink in the unused discharging ports from becoming overly viscous in the cource of the ordinary recording, a preliminary discharging is performed at this position periodically. In this respect, FIG. 14A is a side view showing the vicinity of the aforesaid position.

Further, as shown in FIG. 13B, when the lead screw 2 is rotated to move the carrier 6 in the direction indicated by arrow B, the clutch gear 4 is pressed by the pressure portion 6*a* to be moved also in the direction indicated by arrow B to allow its starting tooth $4c_1$ to be in a position to engage with the starting tooth $21b_1$ of the timing gear 21. Subsequently, the clutch gear 4 is rotated in synchronism with the lead screw 2 to enable the starting tooth $21b_1$ and starting tooth $4c_1$ to be engaged so that the timing gear 21 rotates in the direction indicated by arrow D in FIG. 14B. On the other hand, the carrier 6 is not moved even if the lead screw 2 rotates because the lead pin 7 is fitted into the groove 3*b* from the induction groove 3*c*.

When the timing gear 21 rotates in the direction D, the setting lever 20 begins to rotate in the direction indicated by arrow E because its gear portion and setting lever 20 are engaged. Until this time, only the setting lever 20 rotates since the hook 16*c* is coupled to the nail portion of the chassis and the blade lever 16 is at rest. In due course, the set face 20*f* of the setting lever 20 rotates in the direction indicated by arrow F while pressing down the rotational piece 18*a* of the blade shaft 18. Hence, the blade 17 rotates in the direction indicated by arrow G to be set in a state where the blade can engage itself with the discharging port surface.

Further, when the timing gear 21 rotates in the direction D, the hook portion 16*c* of the blade lever 16 is released from the nail portion of the chassis, and the setting lever 20 and blade lever 16 further rotate to enable the blade 17 to slide on the discharging port surface of the head 9 for cleaning as shown in FIG. 14C.

Here, as described earlier, there is a possibility that the blading trouble hindering the normal discharging of the discharging nozzle, such as the rubbing of foreign particles and overly viscous ink into the discharging nozzle by wiping or dragging of foreign particles on the surface to cover the discharging nozzle. However, in the present embodiment, the structure is arranged so that before the blade slides to rub the discharging nozzle, the blade slidably rubs the non-discharging nozzle portion thereby to reduce significantly the frequency of the above-mentioned trouble to occur.

Figure 23A:
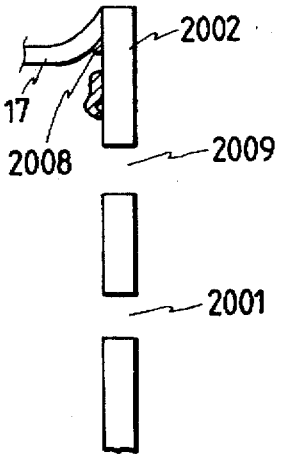
FIGS. 23A through 23C are views illustrating the behavior of the foreign particle on the face at the time of wiping operation showing one structural example embodying the present invention.
Figure 23B:
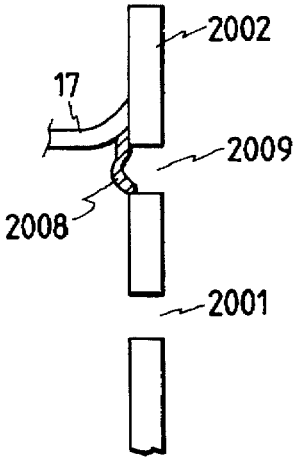
Figure 23C:
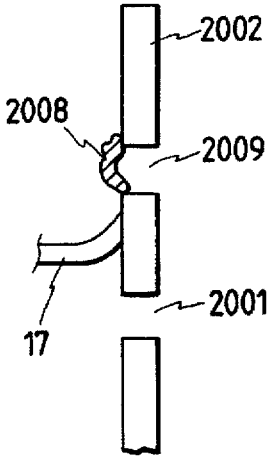

Specifically, the wiping of the present embodiment is of such a structure as described earlier that the blade slidably rubs the discharging port surface from the top to the bottom in the direction of the nozzle column. Therefore, in the upper side of the uppermost discharging nozzle, i.e., in the upstream side of the discharging nozzle in the direction of the blade performing the slidable rubbing, the non-discharging nozzle is arranged. With this nozzle arrangement, the blade slidably rubs them including the non-discharging nozzle. When the wiping is performed on the surface with such nozzle arrangement, the foreign particles are removed in a fashion given below. As shown in FIG. 23, a foreign particle 2008 on the orifice plate 2002 shifts its location by being dragged by blade 17 when the wiping is performed. In the head of the present embodiment, the non-discharging nozzle is provided above the discharging nozzle. Therefore, the foreign particle 2008 dragged by the blade to shift its position is caught by this non-discharging nozzle and is removed thereby to prevent the foreign particle from reaching the discharging nozzle.

In the present embodiment, the distinction of discharging nozzle/non-discharging nozzle is not especially made in designing the structure of the recording head, and if 60 pieces of discharging nozzles are required for a recording head, 64 pieces of nozzles are structured, for example, and the four pieces of nozzles are not driven to perform the discharging but are used as the non-discharging nozzles. In this way, it becomes easy to obtain the positional precision of the discharging nozzles and non-discharging nozzles so as to reduce the frequency of the foreign particle reaching the discharging port after escaping from the catch of the non-discharging port.

In this respect, the structure of discharging nozzle/driving control method being known art, the descriptions thereof are omitted.

The foreign particle caught by the non-discharging nozzle increases as the number of wiping increases. However, as described earlier, the suction recovery operation is performed in an ink jet recording apparatus. Although the afore-said non-discharging port is not necessarily connectively communicated with the common liquid chamber, if it is connectively communicated therewith as in the case of the present embodiment, ink is sucked from the non-discharging port particularly at the time of suction recovery operation, and the foreign particles caught by the non-discharging port is also removed at the time of such suction recovery operation; thus making it possible to maintain the function to catch the foreign particle as in the initial state.

Also, the non-discharging nozzle is a nozzle which is not concerned with the recording. Therefore, it is not necessary for the non-discharging nozzle to be provided with the electrothermal converter 2005, but it may be possible to make arrangement so that the non-discharging nozzle is also controlled to perform the preliminary discharging to make use of the cleaning effect of the preliminary discharging.

In this respect, the more the numbers of non-discharging nozzles are, the greater is the effect, but the consumption of ink increases as the numbers of the non-discharging nozzles increase. In practice therefore, it is desirable to set the numbers of the non-discharging nozzles three or more to thirty pieces.

Further, in the present embodiment, the direction of the slide rubbing of the blade is from the top of the discharging port surface to the bottom thereof as an desirable example, but the direction can be from the bottom of the discharging port surface to the top thereof. In this case, however, the position of the non-discharging nozzle should be in the lower side of the discharge port surface in the upstream than the discharging nozzle in the direction in which the blade performs its slidable rubbing.

The ink liquid and others removed by the slidable rubbing of the blade 17 are exhausted only to the lower part of the discharging port surface, and the exhausted ink liquid and others are sucked or kept in the upper part of the ink carrier 19. Also, at this juncture, the ink carrier 19 begins to contact the ink absorbent 23. Further, when the setting lever 20 rotates, the ink carrier 19 and blade 17 slidably rub the surface of the wiper portion 23*a* of the ink absorbent 23 as shown in FIG. 14D. Consequently, the ink received by the ink carrier 19 at the time of preliminary discharging and the dusts and others wiped off by the blade 17 form the discharging port surface are received by the wiper portion 23*a* and at the same time, the ink droplets adhering to the discharging port surface are also sucked. Thus, the ink absorbing capability of the ink carrier 19 is maintained for a long time.

Further, the timing gear 21 rotates in the direction D. However, the stopping teeth 20*a* and 20*b* of the setting lever 20 and the stopping cam 21*a* of the timing gear 21 face to be in contact with each other to regulate the rotation of the setting lever 20. At the same time, the timing gear 21 presents itself the portion where no driving teeth are provided and no force is also exerted to rotate the setting lever 20.

When the timing gear 21 further rotates, the cap 35 is stopped at the position away from the discharging port surface of the head element 9*a* as shown in FIG. 15A because the cap cam 21*c* of the timing gear 21 regulates the rotational shaft 32*a* of the capping lever 32 at the early stage as shown in FIG. 8. Subsequently, when the timing gear 21 further rotates in the direction D, the capping lever 32 and cap cam 21*c* are disengaged to release the aforesaid state of regulation, and as shown in FIG. 15B, the rotational lever 24*f* of the cylinder 24 is tensioned by the spring portion 22*b* of the ink absorbent spring 22 to allow the cylinder 24 to rotate in the direction F. Then, the cap portion 35*a* of the cap 35 presses the discharging port surface to terminate the capping operation. In this respect, FIG. 13B shows the upper face view at this juncture. Then, at this time, the seal face 32*d* and cap seal portion 35*d* are also closely sealed by the pressure of the cap.

So far the cleaning of the nozzle surface and capping operation have been described. Usually, the operation comes to a stop here, and the recording operation begins by performing the above-mentioned operation reversely in response to the subsequent recording signal input.

Next, the description will be made of the suction recovery operation which is performed in the case where the discharging condition has not been improved by the preliminary discharging or the like.

To actuate such suction recovery, the timing gear 21 should rotate further from the capping position to enable the cap 35 to leave the discharging port formation surface slightly as shown in FIG. 15C by pressing the capping lever 32 with the cap cam 21*f*.

With the timing gear 21 rotating further in the direction D, the capping lever 32 and cap cam 21*f* are again disengaged so that the cap portion 35*a* is allowed to be in contact with the discharging port surface.

Now, the operation of the pump will be described. Here, the suction operation, which is an recovery operation, begins subsequent to the completion of the aforesaid air-tight cap closure.

At this time, the piston setting cam 21*g* presses the piston pressure roller 29 mounted on the piston rod 27 at first by the rotation of the timing gear 21 to allow the piston rod 27 to be moved in the direction H as shown in FIG. 16A. Then, the piston 28 is compressed by the piston bracket 27*b* to move in the direction H, and the pump chamber 42 becomes negatively pressurized. There is a skin layer on the outer periphery of the piston 28 and the contacting surface of the piston bracket 27*b*, so that no ink leakes through the open cells of the foam material.

Also, the ink path 24*e* of the cylinder 24 is closed by the piston 28. Thus, only as the negative pressure in the pump chamber 42 increases, the piston 28 in a state of being movable. Meanwhile, subsequent to the aforesaid recapping, the ink path 24*e* is opened as shown in FIG. 16A. Accordingly, ink in the head 9 is sucked from the suction inlet 35*b* of the cap 35. The sucked ink flows into the pump chamber 42 through the ink path 32*f* formed in the capping lever 32, the connectively communicative hole in the lever seal 33 and further, through the ink path 24*e* in the cylinder 24.

When the timing gear 21 further rotates, the cap 35 is caused to leave again the discharging port surface slightly by the function of the cap cam 21*h*, and by the remaining negative pressure in the pump chamber, ink on the discharging port surface and in the cap portion 35*a* are sucked to clean off the residue of ink of these portions.

Subsequently, when the timing gear 21 is reversely rotated (in the direction indicated by arrow I in FIG. 14D), the piston resetting cam 21*i* draws the piston returning roller 30, and as shown in FIG. 16B, the piston rod 27 is allowed to move in the direction indicated by arrow J. At this juncture, the piston 28 moves after the piston receiver 27*c* of the piston rod 27 has been in contact therewith. As a result, there occurs a space Δ1 between the end face 28*b* of the piston 28 and the piston bracket 27*b*.

Then, the movement of the piston rod 27 and piston 28, the waste ink sucked into the pump chamber 42 is exhausted to the vicinity of the central portion of the waste ink absorbent 37 through the aforesaid space Δ1, the groove 27*f* of the piston rod, the ink path 24*c* of the cylinder 24, and further, through the waste ink tube 24*g*. At this juncture, in this respect, the ink path 24*e* of the cylinder 24 has been closed by the piston 28 at the early stage of its movement, so that the waste ink cannot flow reversely in the direction toward the cap.

FIG. 17 is a diagram showing all together the sequence of the preliminary discharging or suction recovery set forth above. In FIG. 17, however, there is shown the sequence which enables the blade to function in such a way that the blade 17 is in standby state to perform the wiping (in a state of being set. Refer to FIG. 14B), then the blade 17 is in a state of being inclined to the absorbent 23 subsequent to the completion of wiping (in a state of being reset. Refer to FIG. 14A), and after that, the blade 17 is in a state of being able to perform the wiping immediately before the setting lever 20 has returned to its original position (in a state of being set).

Now, in reference to FIG. 3A and FIG. 3B, the description will be made of the recording paper conveying mechanism of the recording apparatus embodying the present invention from the recording to the paper exhausting operation.

Figure 18A:
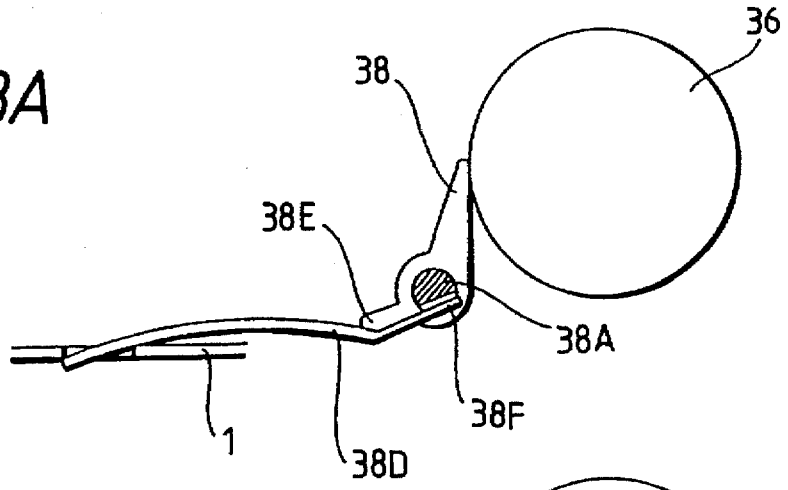
FIGS. 18A and 18B are side views showing the pressure operation mechanism of the paper pressure plate embodying the present invention.
Figure 18B:
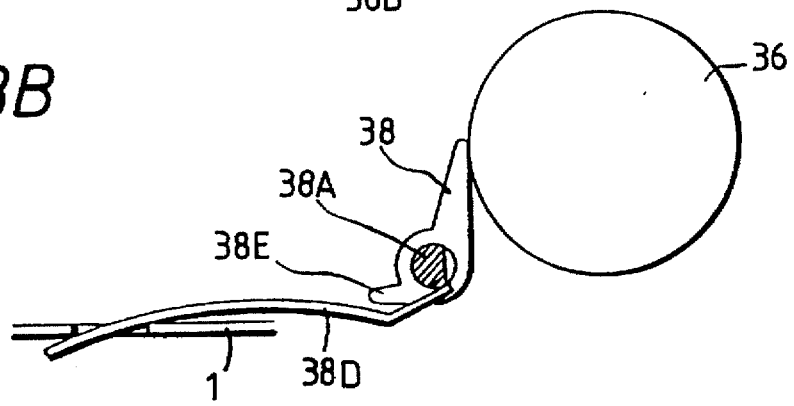

In FIGS. 3A and 3B, a reference numeral 38 designates the above-mentioned paper pressure plate made of fluororesin, carbon fiber mixture, or the like to exert pressure upon the recording paper being fed so that a predetermined space is maintained between the discharging port surface of the recording head 9 and the recording paper. The pressure exerted by this paper pressure plate 38 is generated by the resiliency of the flat spring 38D. FIG. 18A and FIG. 18B illustrate this mechanism in detail.

FIG. 18A is a view showing a state that the paper pressure plate 38 functions to give pressure to the roller 36. In this case, the cutaway portion of a shaft 38A, which is slidable in the rotational direction of the paper pressure plate 38, having a D letter shape formed by cutting linearly a part of its periphery, is positioned to be in contact with the leading end 38F of a spring board 38D. At this juncture, the end portion of the paper pressure plate 38E is tensioned upward in FIG. 18A by the spring board 38D. Thus, the paper pressure plate 38 tends to rotate clockwise with the shaft 38A as its center to give pressure to the paper feeding roller 36.

On the other hand, FIG. 18B is a view showing a state that the pressure exerted by the paper pressure plate 38 is released. In this case, the shaft 38A rotates to press the leading end 38F with the circular portion of the shaft 38A. Then, the spring board 38D is compressed downward totally. Consequently, the end portion 38E is not tensioned by the spring board 38D.

In this state where the tension has been released, the paper pressure plate 38 is not caused to change its rotational position greatly because the shaft 38A and paper pressure plate 38 are fitted with a certain friction. Thus even when the pressure of the paper pressure plate 38 should be released, there is no possibility that the movement of the recording head and the like are not hindered by the paper pressure plate.

Also, the above-mentioned paper pressure mechanism is a mechanism capable of providing a pressure just enough in a limited space without hindering the appropriate feeding of recording paper by the paper feeding roller 36.

In other words, the pressure is generated by the flat spring arranged along the bottom chassis 1 which usually presents a dead space, and not by using any resilient member for the paper pressure plate itself. As a result, there is more freedom in setting the pressure by the length of the flat spring, and the miniaturization of the paper pressure plate is possible.

Also, the flat spring 38D is mounted on the chassis 1 by a fixture (not shown).

Now, reverting to FIG. 3A and FIG. 3B, a reference numeral 60 designates a paper exhausting roller for exhausting the recorded paper; and 61, a spur for providing the recording paper conveyed by the paper exhausting roller 60 with pressure to regulate the direction in which the recording paper is exhausted as well as for generating the conveying force.

A reference numeral 62 designates a transmission roller arranged in the intermediate portion between the paper exhausting roller 60 and paper feeding roller 36 foe transmitting the rotation of the paper feeding roller 36 to the paper exhausting roller 60. The transmission of the rotation between them is performed by the friction generated by arranging them to be in contact with each other. The shape of the paper exhausting roller 60 is cylindrical, the diameters at both ends of which differ from that in the intermediate portion thereof, and the transmission roller 62 contacts with the paper exhausting roller 60 at its intermediate portion having the smaller diameter. Accordingly, the both ends having the larger diameter thereby to convey the recording paper rotate slightly faster than the peripheral speed of the paper feeding roller 36. As a result, when the recording paper is exhausted, the recording paper is lightly stretched while being conveyed to maintain the recording surface in a desirable condition.

In this respect, for the rotational shafts of the transmission roller 62 and spur 61, coil springs having appropriate resilient coefficients are used respectively. Taking the case of the spur 61 as an example, the description of such mechanism will be made in detail in reference to FIG. 19.

Figure 19:
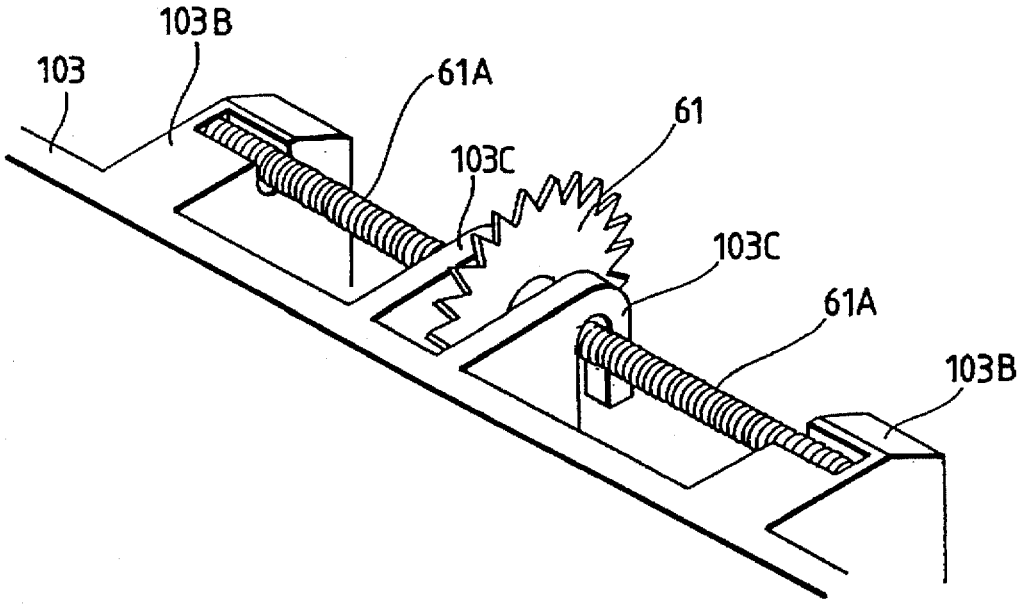
FIG. 19 is an enlargement of the spur portion of the paper exhausting mechanism embodying the present invention.

In FIG. 19, a reference numeral 61A designates a shaft formed with a coil spring extending through the center of the spur 61 to both ends thereof, and connected to the spur 61 rotatively each other; 103B, supporting members for supporting the both ends of the rotational shaft 61A, formed as a part of the inner cover 103 shown in FIG. 1. The supporting members 103B support the shaft 61A slidably in the axial direction thereof; and 103C, regulating members provided at both sides of the spur 61 to regulate the movement of the spur 61 in the axial direction and the direction perpendicular thereto. The regulating members 103C are also formed as a part of the inner cover 103 as in the case of the shaft supporting members 103B.

With the above-mentioned structure, the shaft 61A supports the spur 61 and at the same time, makes it possible to gain the pressure of the spur 61 given to the exhausting roller 60 by its bending resiliency.

The inner cover 103 has a spring member 103A at its rear end portion as shown in FIG. 3A, and by the reaction of the case 101, the inner cover is provided with pressure in the direction toward the paper exhausting roller. With the interrelated function of this pressure and the resiliency of the rotational shaft 61A, the spur 61 functions to provide an appropriate pressure for the paper exhausting roller 60.

Also, receiving the above-mentioned pressure, the inner cover 103 makes the engagement between the fixture 103D of the inner cover 103 and the rotational shaft 60C of the paper exhausting roller 60 reliable as shown in FIG. 3A. As a result, the positional relationship between the spur 61 and paper exhausting roller 60 is constantly maintained all the times. Or it may be possible to maintain a precise relationship irrespective of the precision of the inner cover by butting the rotational shaft 60C to a ratching member for the fixation thereof.

For the transmission roller 62, the function of the rotational shaft 62A formed with the coil spring is the same, and the contacting force to the paper feeding roller 36 and paper exhausting roller 60 is gained by resiliency of the shaft 62A.

The paper exhausting roller 60 is configurated in such a way that the diameter of its intermediate portion is smaller than those of both ends thereof as described earlier. This structure is shown in FIG. 20 in detail.

Figure 20:
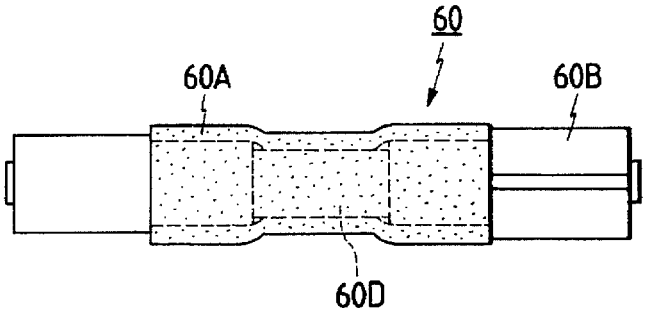
FIG. 20 is a plan view showing an example of the paper exhausting roller embodying the present invention.

In FIG. 20, a reference numeral 60A designates a cover member made of rubber; and 60D, a cylindrical core member having a smaller diameter in its intermediate portion than those of both ends. The paper exhausting roller 60 is formed with the core member 60D covered with the tubular cover member 60A.

As a result, it is possible to obtain the paper exhausting roller comparatively easily at a low cost because a configuration such as this is obtained without any integral formation of rubber material or the like.

In this respect, the groove portion 60B connectively provided at one end of the paper exhausting roller 60 enables the trailing end of the recording paper to be ratched when the recording paper is exhausted, and in the case of the position of the recording paper being deviated or the like, this groove serves to make the paper exhausting reliable.

In this respect, the configuration of the core member 60D is not limited to what has been described above. For example, the core member may be formed by extending the shape of the groove portion 60B as it is with its intermediate portion made thinner, and the cylindrical shape is obtainable by covering such extended portion with rubber material.

(A Second Example Embodying the Present Invention)

Subsequently, in reference to the accompanying drawings, another example embodying the present invention for enhancing the probability of catching the foreign particles by non-discharging nozzle will be described.

Figure 24:
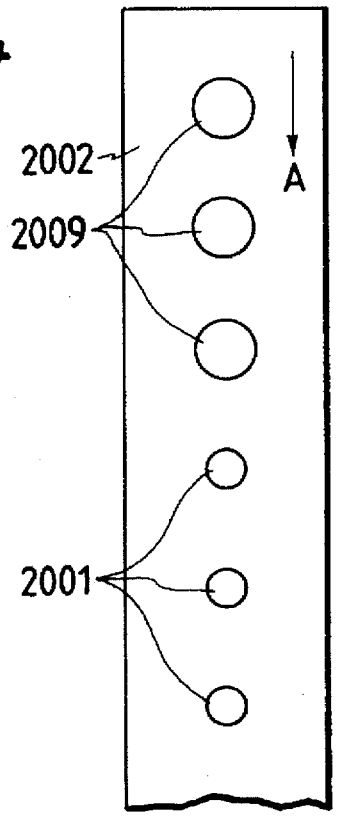
FIG. 24 is view schematically showing the structure of one embodiment of the discharging port formation surface of a structural example embodying the present invention.
Figure 26:
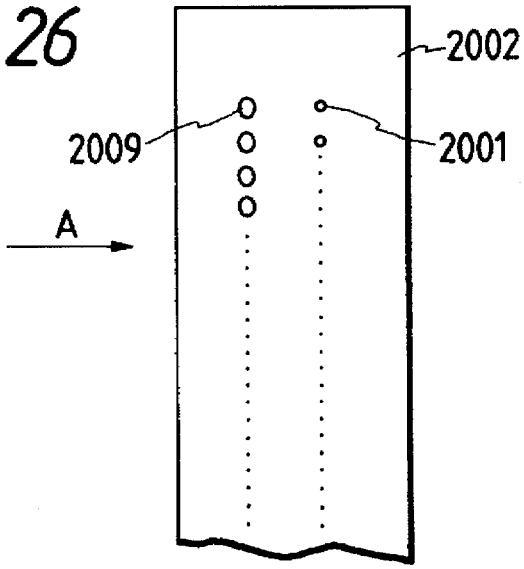
FIG. 26 is a view schematically showing the structure of still another embodiment of the discharging port formation surface of a structural example embodying the present invention.

In FIG. 24, a reference numeral 2001 designates the discharging port of the discharging nozzle; and 2009, the discharging port of the non-discharging nozzle, and the direction indicated by arrow A represents the wiping direction.

In the case where the non-discharging nozzle and discharging nozzle are of the same shape, a foreign particle is not caught by the non-discharging nozzle due to the precise arrangement of the hole positions on the orifice plate, and the foreign particle reaches the discharging nozzle, which is caught thereby to present the possibility that the discharging is hindered from being properly performed.

However, if the diameter of the non-discharging nozzle is made larger than that of the discharging nozzle as shown in FIG. 24, the aforesaid problem can be solved.

Also, the optimum diameter of the non-discharging nozzle to catch the foreign particle with ease differs depending on the shape and size of the foreign particle. For example, there can be a case where the catching probability becomes higher when the diameter of the non-discharging nozzle is made smaller than that of the discharging nozzle. Therefore, it may be possible to form the non-discharging nozzle group with a mixture of large and small diameter ones.

It is desirable to make the diameter of the non-discharging nozzle approximately 10μ to 90μ, but as described earlier, if the diameter thereof is defined larger than that of the discharging nozzle, the diameter should desirably be 40μ to 90μ.

Also, the number of the non-discharging nozzle is not necessarily plural if a particular non-discharging nozzle has a larger diameter than that of the discharging nozzle as well as a sufficient capability of catching the foreign particle; in such a case, only one may serve the purpose.

Figure 21:
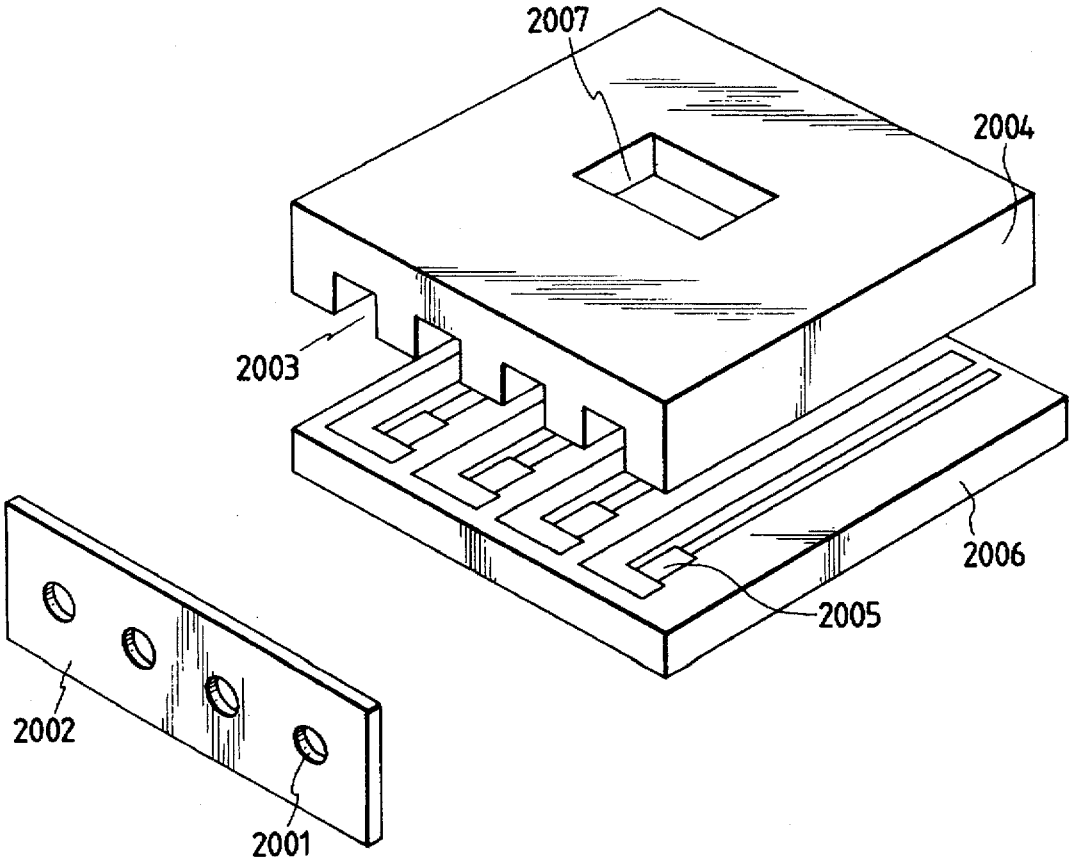
FIG. 21 is a perspective view showing the structure of the recording head.
Figure 22A:
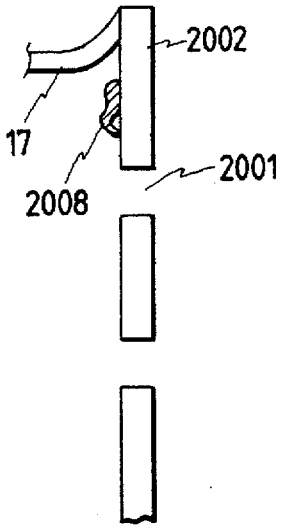
FIGS. 22A through 22C are views illustrating the behavior of the foreign particle on the face at the time of wiping operation.
Figure 22B:
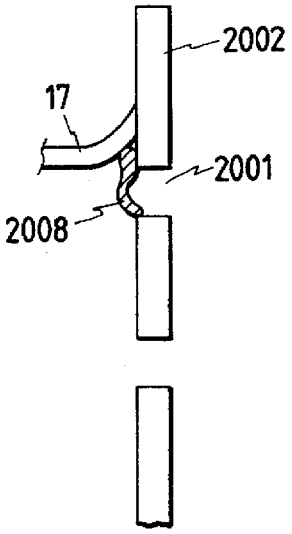
Figure 22C:
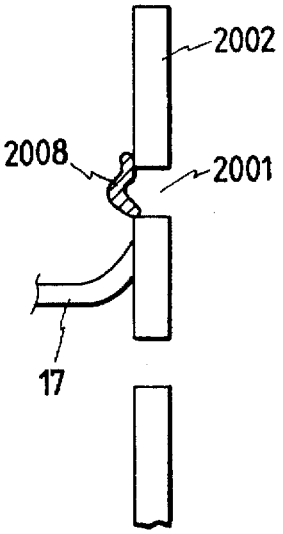

In this respect, the recording head used in the example embodying the present invention constitutes the nozzle path independent of the orifice plate 2002 as described in conjunction with FIG. 21. Therefore, it is easy to make the diameters of the non-discharging nozzle and discharging nozzle.

The structures and functions other than those for optimizing the diameter of the non-discharging nozzle are the same as the aforesaid embodiment. Accordingly, the descriptions thereof will be omitted.

(A Third Example Embodying the Present Invention)

In the second example embodying the present invention, the diameter of the orifice of the non-discharging nozzle is made larger than that of the discharging nozzle thereby to implement the reduction of the probability that the foreign material can reach the discharging nozzle portion. It may also be possible to optimize the orifice configuration of the non-discharging nozzle for the reduction of the probability that the foreign particle can reach the discharging nozzle portion.

In FIGS. 25A through 25F, a reference numeral 2001 designates the discharging port of the discharging nozzle; and 2009, the discharging port of the non-discharging nozzle, and the direction indicated by arrow A represents the wiping direction.

Figure 25A:
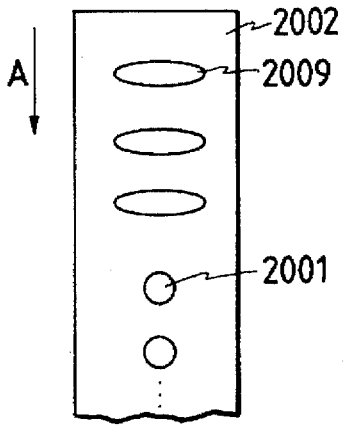
FIGS. 25A through 25F are views schematically showing the structure of another embodiment of the discharging port formation surface of a structural example embodying the present invention.

As shown in FIG. 25A, the discharging nozzle 2001 remains to be circular in order to stabilize the discharging direction whereas the non-discharging nozzle 2009 is oval having its major axis in the direction intersecting the direction of the blade movement. By making the length of the rim longer in the direction intersecting the direction of the blade for the non-discharging port, it becomes easier to catch the foreign particle.

Figure 25B:
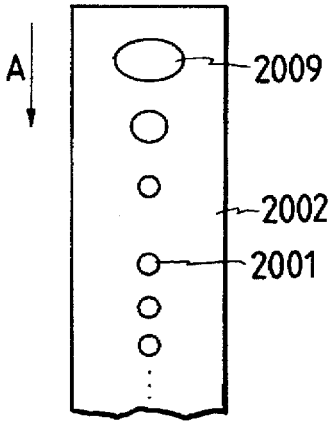

Also, as shown in FIG. 25B, it may be possible to arrange a plurality of the non-discharging ports 2009 by varying the sizes thereof. In this case, the one having the largest diameter is arranged at the upstream side of the direction of the blade advancement or the non-discharging port having a rim is arranged in such a way that the length of the rim becomes longest in the direction intersecting the direction of the blade advancement. Then, the diameters of the non-discharging ports are made gradually smaller as positioned further at the down-stream side; hence making it possible to remove the large foreign particles to the small ones efficiently.

Figures 25C, 25D, 25E, 25F:
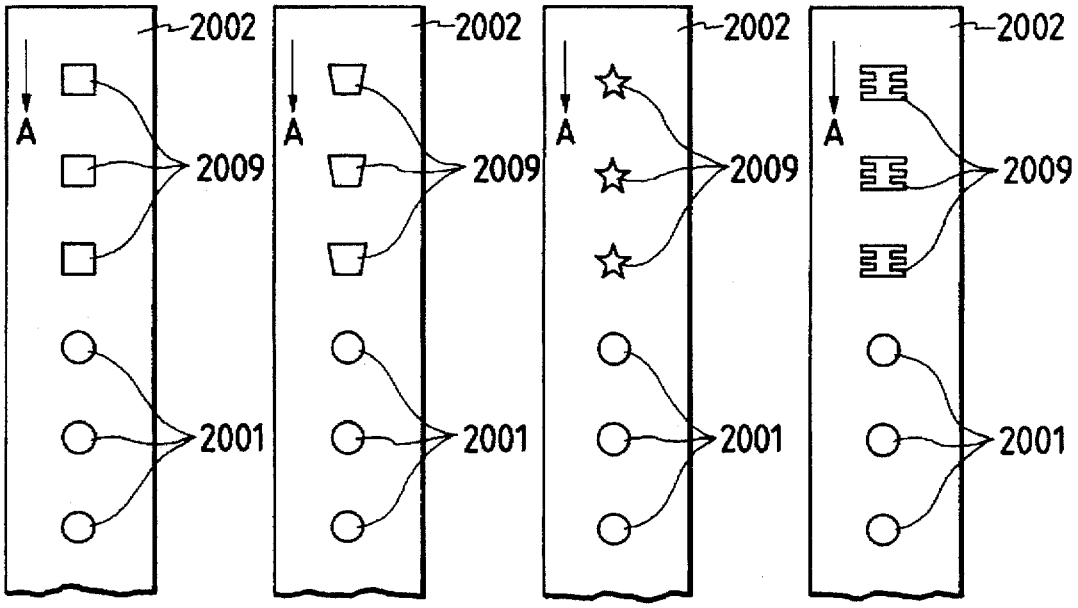

In FIG. 25C, the discharging nozzle 2001 is of the real circular type to stabilize the discharging direction whereas the discharging port of the non-discharging nozzle 2009 is of the poligonal type to enhance the effect of scraping off the foreign particle on the blade. It is desirable to adopt the type depending on the kind of the foreign particle which should be removed mainly. In other words, if paper particles are the main object that should be removed for a recording apparatus generating them, a discharging port configuration suited for an easy removal of the paper particles such as shown in FIG. 25D is desirable, for example. In this configuration, the bottom portion is positioned perpendicular to the direction of the blade advancement, and the left and right sides are narrower toward downward; hence making it particularly easy to catch the paper particles.

In addition, as shown in FIG. 25E and FIG. 25F, it is possible to configure the shape in accordance with the kinds of the foreign particles.

Also, in this example embodying the present invention, the non-discharging nozzles are arranged with equal intervals in the direction of the blade movement, but it may be possible to make such arrangement with different intervals as a matter of course. Particularly, in the case of the arrangement of the non-discharging ports 2009 as shown in FIG. 25B, it is possible to enhance the removal efficiency of the foreign particles by varying the intervals gradually.

In this respect, the recording head used in this example embodying the present invention constitutes the orifice plate 2002 independent of the nozzle path as described in conjunction with FIG. 21. Therefore, it is easy to make the configurations of the discharging nozzle 2001 and non-discharging nozzle 2009 different.

The structures and functions other than those for differentiating the configurations of the discharging nozzle and non-discharging nozzle are the same as the aforesaid example embodying the present invention, and the descriptions thereof will be omitted.

Further, in the aforesaid example embodying the present invention, the simplification of the manufacturing is attempted by enabling the non-discharging port to be the portion where the foreign particles are caught. However, it may be possible to provide a concavity, which is not the non-discharging port, but with which the foreign particles can be removed.

In this respect, the present invention produces excellent effect on the ink jet recording head and recording apparatus particularly of the ink jet recording type which forms flying droplets by the utilization of thermal energy for recording. With a method such as this, a higher density and finer precision of recording can be attained, and it is predicted that depending on the recording patterns, the variations of the settling speed, quicker or slower, are generated.

For the typical structure and principle thereof, it is desirable to adopt for its implementation the fundamental principle disclosed, for example, in the specifications of U.S. Pat. No. 4,723,129 and U.S. Pat. No. 4,740,796. This method is applicable to either so-called on damand type and continuance type. Particularly, in the case of the on demand type, at least one driving signal, which gives a recording liquid a rapid temperature rise exceeding the nuclear boiling, is applied in response to the recording information provided for the electrothermal converter arranged with respect to a sheet or liquid path holding a recording liquid (ink) thereby causing the electrothermal converter to generate thermal energy. Hence, film boiling is generated on the thermoactive plane of the recording head, resulting in the formation of bubble in the recording liquid (ink) one to one in response to this driving signal efficiently. The recording liquid (ink) is discharged into the atmosphere through the discharging port by the active force generated in the course of the growth and contraction of this bubble to form at least one droplet. It is more desirable to produce this driving signal in the form of pulses. Then, the growth and contraction of the bubble is appropriately performed instantaneously to implement the discharging of recording liquid (ink) having particularly excellent responsibility. For this pulse type driving signal, the one such as disclosed in the specifications of U.S. Pat. No. 4,463,359 and U.S. Pat. No. 4,345,262 is suitable. In this respect, if the condition disclosed in the specification of U.S. Pat. No. 4,313,124 concerning the invention as regards the temperature rise on the above-mentioned thermoactive plane, it is possible to perform an excellent recording in a better condition.

As the structure of the recording head, the present invention includes a combination of the discharging port, liquid path, electrothermal converter (linear liquid path or rectangular liquid path) such as disclosed in each of the above-mentioned specifications as well as the structure having the thermoactive portion arranged in the bending region using the configuration disclosed in the specifications of U.S. Pat. No. 4,558,333 and U.S. Pat. No. 4,459,600. In addition, the present invention is effective with the structures such that, for a plurality of electrothermal converters, a common slit is structured as the discharging port of the electrothermal converter as disclosed in Japanese Patent Laid-Open Application 59-123670 or the structure in which an opening to absorb the pressurized wave of thermal energy is arranged to face the discharging port as disclosed in Japanese Patent Laid-Open Application 59-138461. In other words, with the present invention, the recording is performed reliably and efficiently irrespective of the modes of the recording heads.

In addition, in the serial type recording apparatus as exemplified above, the present invention is effective in using a recording head fixed to the main body of the recording apparatus, a freely replaceable chip type recording head for which the electrical connection to the main body of the recording apparatus and ink supply become possible when it is installed therein, or a cartridge type recording head having the ink tank integrally provided for the recording head itself.

Also, as to the kind of recording head installed or the numbers thereof, it may be possible to install a plurality of recording heads with respect to the different kinds of ink having different recording colors and densities besides the one having only one recording head for a monochrome ink.

Furthermore, as the mode of the ink jet recording apparatus according to the present invention, there may be those used for copying machines in combination with readers, and facsimile apparatuses having transmitter and receiver, or the like in addition to the image output terminals for a computer or other information processing apparatuses.

As clear from the above-mentioned description, according to the present invention, the non-discharging nozzle is structured to catch foreign particle and overly viscous ink on the blade; thus making it possible to keep the blade clean at all times when the blade slidably rubs the discharging nozzle.

Also, the foreign particle on the face dragged by the blade is caught by the non-discharging nozzle to prevent it from being transferred to the discharging port. Therefore, the frequency of the hindrance to the discharging caused by such dragged foreign particle onto the discharging port can be reduced.

Also, from the non-discharging nozzle, ink is sucked equally from the discharging nozzle at the time of suction recovery operation. Consequently, it is possible to keep the foreign particle catching function for a long time as efficient as at its initial stage because the non-discharging nozzle is also cleaned whenever the suction recovery operation is performed.

As a result, while the drawback of the wiping is minimized, the blading effect is maximized thereby enabling the ink jet recording head to perform a stable recording.

What is claimed is:

1. An ink jet recording head mountable on a recording apparatus having a cleaning member which moves, relative to the ink jet recording head, into contact with a surface provided with an ink discharge port and having an area provided with said ink discharge port for discharging ink and which serves to clean said area, said recording head comprising:

a recessed portion provided at said area and in a vicinity of said ink discharge port, said recessed portion being positioned in a route of said cleaning member moving in contact with said ink discharge port and upstream of said ink discharge port with respect to a moving direction of said cleaning member as it moves relative to the ink jet recording head and relative to the surface provided with the ink discharge port.

2. An ink jet recording head according to claim 1, wherein said recessed portion is larger than said discharge port.

3. An ink jet recording head according to claim 2, wherein said recessed portion is of a size which is 0.5 times or more and 3 times or less that of said discharge port.

4. An ink jet recording head according to claim 2, wherein if said recessed portion is larger than the size of said discharge port, one recessed portion or more are provided and if said recessed portion is substantially a same size as said discharge port or smaller, three recessed portions or more are provided.

5. An ink jet recording head according to claim 2, wherein said ink jet recording head discharges ink droplets by utilization of heat generated by an electrothermal converting element.

6. An ink jet recording head according to claim 1, wherein said recessed portion is of substantially a same size as said discharge port, and a plurality of the recessed portions are provided.

7. An ink jet recording head according to claim 6, wherein said recessed portion is of a size which is 0.5 times or more and 3 times or less that of said discharge port.

8. An ink jet recording head according to claim 6, wherein if said recessed portion is larger than the size of said discharge port, one recessed portion or more are provided and if said recessed portion is substantially the same size of said discharge port or smaller, three recessed portions or more are provided.

9. An ink jet recording head according to claim 6, wherein said ink jet recording head discharges ink droplets by utilization of heat generated by an electrothermal converting element.

10. An ink jet recording head according to claim 1, wherein said recessed portion is of a size which is 0.5 times or more and 3 times or less that of said discharge port.

11. An ink jet recording head according to claim 1, wherein if said recessed portion is larger than the size of said discharge port, one recessed portion or more are provided and if said recessed portion is substantially a same size as said discharge port or smaller, three recessed portions or more are provided.

12. An ink jet recording head according to claim 1, wherein said ink jet recording head discharges ink droplets by utilization of heat generated by an electrothermal converting element.

13. An ink jet recording apparatus for performing recording by discharging ink for a recording head, wherein said ink jet recording apparatus comprises:

a cleaning member which moves, relative to the ink jet recording head, into contact with a surface provided with an ink discharge port and having an area provided with said ink discharge port for discharging ink and which serves to clean said area; and a supporting member for mounting therein the recording head, said recording head comprising a recessed portion provided at said area and in a vicinity of said ink discharge port, said recessed portion being positioned in a route of said cleaning member moving in contact with said ink discharge port and upstream of said ink discharge port with respect to a moving direction of said cleaning member as it moves relative to the ink jet head and relative to the surface on which the ink discharge port is formed.

14. An ink jet recording apparatus according to claim 13, wherein said recessed portion is of a size which is 0.5 times or more and 3 times or less that of said discharge port.

15. An ink jet recording apparatus according to claim 13, wherein if said recessed portion is larger than the size of said discharge port, one recessed portion or more are provided and if said recessed portion is substantially a same size as said discharge port or smaller, three recessed portions or more are provided.

16. An ink jet recording apparatus according to claim 13, wherein said ink jet recording head discharges ink droplets by utilization of heat generated by an electrothermal converting element.

17. An ink jet recording apparatus as in claim 13, wherein said cleaning member travels relatively in the direction parallel to the direction in which said recording head travels to scan.

18. An ink jet recording head mountable on a recording apparatus having a cleaning member which moves, relative to the ink jet recording head, into contact with a surface provided with an ink discharge port and having an area provided with said ink discharge port for discharging ink and which serves to clean said area, said recording head comprising:

a recessed portion provided at said area and in a vicinity of said surface provided with said ink discharge port, said recessed portion being positioned in a contact moving route of said cleaning member moving in contact with said surface provided with said ink discharge port and upstream of said ink discharge port with respect to a moving direction of said cleaning member as it moves relative to the ink let recording head and relative to the surface provided with the ink discharge port.

19. An ink jet recording head according to claim 18, wherein said recessed portion is larger than said discharge port.

20. An ink jet recording head according to claim 19, wherein said recessed portion is of a size which is 0.5 times or more and 3 times or less that of said discharge port.

21. An ink jet recording head according to claim 19, wherein if said recessed portion is larger than the size of said discharge port, one recessed portion or more are provided and if said recessed portion is substantially a same size as said discharge port or smaller, three recessed portions or more are provided.

22. An ink jet recording head according to claim 19, wherein said ink jet recording head discharges ink droplets by utilization of heat generated by an electrothermal converting element.

23. An ink jet recording head according to claim 18, wherein said recessed portion is of substantially a same size as said discharge port, and a plurality of the recessed portions are provided.

24. An ink jet recording head according to claim 23, wherein said recessed portion is of a size which is 0.5 times or more and 3 times or less that of said discharge port.

25. An ink jet recording head according to claim 23, wherein if said recessed portion is larger than the size of said discharge port, one recessed portion or more are provided and if said recessed portion is substantially the same size of said discharge port or smaller, three recessed portions or more are provided.

26. An ink jet recording head according to claim 23, wherein said ink jet recording head discharges ink droplets by utilization of heat generated by an electrothermal converting element.

27. An ink jet recording head according to claim 18, wherein said recessed portion is of a size which is 0.5 times or more and 3 times or less that of said discharge port.

28. An ink jet recording head according to claim 18, wherein if said recessed portion is larger than the size of said discharge port, one recessed portion or more are provided and if said recessed portion is substantially a same size as said discharge port or smaller, three recessed portions or more are provided.

29. An ink jet recording head according to claim 18, wherein said ink jet recording head discharges ink droplets by utilization of heat generated by an electrothermal converting element.

30. An ink jet recording apparatus for performing recording by discharging ink from a recording head, wherein said ink jet recording apparatus comprises:

a cleaning member which moves, relative to the ink jet recording head, into contact with a surface provided with an ink discharge port and having an area provided with said ink discharge port for discharging ink and which serves to clean said area;

a supporting member for mounting therein the recording head, said recording head comprising a recessed portion provided at said area and in a vicinity of said ink discharge port, said recessed portion being positioned in a route of said cleaning member moving in contact with said surface provided with said ink discharge port and upstream of said ink discharge port with respect to a moving direction of said cleaning member as it moves relative to the ink jet recording head and relative to the surface provided with the ink discharge port; and means for discharging ink from said recessed portion.

31. An ink jet recording apparatus according to claim 30, wherein said means for discharging ink from said recessed portion is a pressure generating means for discharging ink which is provided in an ink path connectively communicating said recessed portion with an ink liquid chamber.

32. An ink jet recording apparatus according to claim 31, wherein said recessed portion is of a size which is 0.5 times or more and 3 times or less that of said discharge port.

33. An ink jet recording apparatus according to claim 31, wherein if said recessed portion is larger than the size of said discharge port, one recessed portion or more are provided and if said recessed portion is substantially a same size as said discharge port or smaller, three recessed portions or more are provided.

34. An ink jet recording apparatus according to claim 31, wherein said recording head discharges ink droplets by utilization of heat generated by an electrothermal converting element.

35. An ink jet recording apparatus according to claim 30, wherein said means for discharging ink from said recessed portion is a recovery means which is in contact with said surface provided with said ink discharge port to constitute a space between the discharging port formation surface and said means and enables an inside of said space to be pressurized negatively.

36. An ink jet recording apparatus according to claim 35, wherein said recessed portion is of a size which is 0.5 times or more and 3 times or less that of said discharge port.

37. An ink jet recording apparatus according to claim 35, wherein if said recessed portion is larger than the size of said discharge port, one recessed portion or more are provided and if said recessed portion is substantially a same size as said discharge port or smaller, three recessed portions or more are provided.

38. An ink jet recording apparatus according to claim 35, wherein said recording head discharges ink droplets by utilization of heat generated by an electrothermal converting element.

39. An ink jet recording apparatus according to claim 30, wherein said recessed portion is of a size which is 0.5 times or more and 3 times or less that of said discharge port.

40. An ink jet recording apparatus according to claim 30, wherein if said recessed portion is larger than the size of said discharge port, one recessed portion or more are provided and if said recessed portion is substantially a same size as said discharge port or smaller, three recessed portions or more are provided.

41. An ink jet recording apparatus according to claim 30, wherein said recording head discharges ink droplets by utilization of heat generated by an electrothermal converting element.

42. An ink jet recording apparatus as in claim 30, wherein said cleaning member travels relatively in the direction parallel to the direction in which said recording head travels to scan.

43. An ink jet recording apparatus capable of mounting therein a recording head having ink discharging ports arranged along the gravity direction, at a same time, performing the recording by discharging ink from said discharging ports while moving on a recording medium in a direction intersecting a direction in which said recording medium is conveyed, wherein said ink jet recording apparatus comprises:

a cleaning member movable along a gravity direction from a top to a bottom to clean a surface provided with said ink discharging ports; and a supporting member for mounting therein the recording head provided with a plurality of concavities of substantially a same size as said discharging ports in a moving path of the cleaning member on the surface provided with said ink discharging ports cleaned by said cleaning member at an upstream side from a discharging port formation area for discharging ink.

44. An ink jet recording apparatus according to claim 43, wherein said concavity is connectively communicated through ink path with an ink liquid chamber with which said discharging ports is connectively communicated.

45. An ink jet recording apparatus according to claim 43, wherein said concavity is of a size which is 0.5 times or more and 3 times or less that of said discharging ports.

46. An ink jet recording apparatus according to claim 43, wherein if said concavity is larger than the size of said discharging ports, one concavity or more are provided and if said concavity is substantially the same size of said discharging ports or smaller, three concavities or more are provided.

47. An ink jet recording apparatus according to claim 43, wherein said ink jet recording head discharges ink droplets by utilization of heat generated by an electrothermal converting element.

48. An ink jet recording apparatus capable of mounting therein a recording head having ink discharging ports arranged along a gravity direction at a same time, performing the recording by discharging ink from said discharging ports while moving on a recording medium in a direction intersecting a direction in which said recording medium is conveyed, wherein said ink jet recording apparatus comprises:

a cleaning member movable along the gravity direction from a bottom to a top to clean a surface provided with said ink discharging ports; and a supporting member for mounting therein the recording head provided with a plurality of concavities of substantially a same size as said discharging ports in the moving path of the cleaning member on said surface provided with said ink discharging ports cleaned by said cleaning member at the upstream side from the discharging port formation area for discharging ink.

49. An ink jet recording apparatus according to claim 48, wherein said concavity is connectively communicated through ink path with an ink liquid chamber with which said discharging ports is connectively communicated.

50. An ink jet recording head according to claim 48, wherein said concavity is of a size which is 0.5 times or more and 3 times or less that of said discharging ports.

51. An ink jet recording apparatus according to claim 48, wherein if said concavity is larger than the size of said discharging ports, one concavity or more are provided and if said concavity is substantially the same size of said discharging ports or smaller, three concavities or more are provided.

52. An ink jet recording apparatus according to claim 48, wherein said ink jet recording head discharges ink droplets by utilization of heat generated by an electrothermal converting element.

53. An ink jet recording head mountable in a recording apparatus provided with a cleaning member capable of cleaning a surface provided with a plurality of ink discharging ports of the recording head for discharging ink by moving relatively in a direction intersecting a direction in which said discharging ports are arranged, wherein said ink jet recording head is provided with one concavity larger than said discharging ports positioned in the moving path of the cleaning member on the surface provided with said ink discharging ports cleaned by said cleaning member at an upstream side in a moving direction from a discharging port formation area for discharge ink.

54. An ink jet recording head according to claim 53, wherein said ink jet recording head discharges ink droplets by utilization of heat generated by an electrothermal converting element.

55. An ink jet recording apparatus capable of mounting therein a recording head having ink discharging ports arranged along a gravity direction, at the same time, performing the recording by discharging ink from said discharging ports while moving on a recording medium in a direction intersecting a direction in which said recording medium is conveyed, wherein said ink jet recording apparatus comprises:

a cleaning member for cleaning a surface provided with said ink discharging ports by moving relatively in a direction parallel to a direction in which said recording head travels to scan; and a supporting member for mounting therein the recording head provided with a concavity in the moving path of the cleaning member on the surface provided with said ink discharging ports cleaned by said cleaning member at an upstream side in a moving direction from a discharging port formation area for discharging an ink.

56. An ink jet recording apparatus according to claim 55, wherein said concavity is connectively communicated through ink path with an ink liquid chamber with which said discharging ports is connectively communicated.

57. An ink jet recording apparatus according to claim 56, wherein said concavity is of a size which is 0.5 times or more and 3 times or less that of said discharging ports.

58. An ink jet recording apparatus according to claim 56, wherein if said concavity is larger than the size of said discharging ports, one concavity or more are provided and if said concavity is substantially a same size as said discharging ports or smaller, three concavities or more are provided.

59. An ink jet recording apparatus according to claim 56, wherein, said ink jet recording head discharges ink droplets by utilization of heat generated by an electrothermal converting element.

60. An ink jet recording apparatus according to claim 55 wherein said concavity is of a size which is 0.5 times or more and 3 times or less that of said discharging ports.

61. An ink jet recording apparatus according to claim 55, wherein if said concavity is larger than the size of said discharging ports, one concavity or more are provided and if said concavity is substantially a same size as said discharging ports or smaller, three concavities or more are provided.

62. An ink jet recording apparatus according to claim 55, wherein, said ink jet recording head discharges ink droplets by utilization of heat generated by an electrothermal converting element.

63. A cartridge member mountable on a recording apparatus having a cleaning member which moves, relative to an ink jet recording head, said ink jet recording head being provided on said cartridge member, into contact with a surface provided with an ink discharge port and having an area provided with said ink discharge port for discharging ink and which serves to clean said area, said cartridge member comprising:

a recessed portion provided at said area and in a vicinity of said ink discharge port, said recessed portion being positioned in a route of said cleaning member moving in contact with said ink discharge port and upstream of said discharge port with respect to a relative moving direction of said cartridge member and said cleaning member; and an ink tank for storing an ink which is discharged from said ink discharge port.

64. A cartridge member according to claim 63, wherein said recessed portion is larger than said discharge port.

65. A cartridge member according to claim 64, wherein said recessed portion is of a size which is between 0.5 and 3 times that of said discharge port.

66. A cartridge member according to claim 64, wherein if said recessed portion is larger than the size of said discharge port, at least one recessed portion is provided and if said recessed portion is substantially a same size as said discharge port or smaller, at least three recessed portions are provided.

67. A cartridge member according to claim 64, wherein said cartridge member discharges ink droplets by utilization of heat generated by an electrothermal converting element.

68. A cartridge member according to claim 64, wherein said cartridge member discharges ink droplets by utilization of heat generated by an electrothermal converting element.

69. A cartridge member according to claim 63, wherein said recessed portion is of substantially a same size as said discharge port, and a plurality of said recessed portions are provided.

70. A cartridge member according to claim 69, wherein said recessed portion is of a size which is between 0.5 and 3 times that of said discharge port.

71. A cartridge member according to claim 69, wherein if said recessed portion is larger than the size of said discharge port, at least one recessed portion is provided and if said recessed portion is substantially a same size as said discharge port or smaller, at least three recessed portions are provided.

72. A cartridge member according to claim 63, wherein said recessed portion is of a size which is between 0.5 and 3 times that of said discharge port.

73. A cartridge member according to claim 63, wherein if said recessed portion is larger than the size of said discharge port, at least one recessed portion is provided and if said recessed portion is substantially a same size as said discharge port or smaller, at least three recessed portions are provided.

74. A cartridge member according to claim 63, wherein said cartridge member discharges ink droplets by utilization of heat generated by an electrothermal converting element.

75. An ink jet recording head mountable on a recording apparatus having a cleaning member which moves, relative to the ink jet recording head, into contact with a surface provided with an ink discharge port and having an area provided with said ink discharge port for discharging ink and which serves to clean said area, said recording head comprising:

a non-discharging nozzle having said ink discharge port, said non-discharging nozzle being positioned in a route of said cleaning member moving in contact with said ink discharge port and upstream of other said ink discharge ports with respect to a moving direction of said cleaning member as it moves relative to the ink jet recording head and relative to the surface provided with the ink discharge port.

76. An ink jet recording head according to claim 75, wherein said discharge port corresponding to said non-discharging nozzle is larger than other said discharge ports.

77. An ink jet recording head according to claim 75, wherein said discharge port corresponding to said non-discharging nozzle is of substantially a same size as other said discharge ports, and a plurality of the discharge ports are provided.

78. An ink jet recording head according to claim 75, wherein said discharge port corresponding to said non-discharging nozzle is of a size which is 0.5 times or more and 3 times or less that of other said discharge ports.

79. An ink jet recording head according to claim 76, wherein said discharge port corresponding to said non-discharging nozzle is of a size which is 0.5 times or more and 3 times or less that of other said discharge ports.

80. An ink jet recording head according to claim 77, wherein said discharge port corresponding to said non-discharging nozzle is of a size which is 0.5 times or more and 3 times or less that of other said discharge ports.

81. An ink jet recording head according to claim 75, wherein if said discharge port corresponding to said non-discharging nozzle is larger than the size of other said discharge ports, at least one recessed portion or more are provided and if said non-discharging nozzle is substantially a same size as other said discharge ports or smaller, at least three recessed portions are provided.

82. An ink jet recording head according to claim 76, wherein if said discharge port corresponding to said non-discharging nozzle is larger than the size of other said discharge ports, at least one recessed portion or more are provided and if said non-discharging nozzle is substantially a same size as other said discharge ports or smaller, at least three recessed portions are provided.

83. An ink jet recording head according to claim 77, wherein if said discharge port corresponding to said non-discharging nozzle is larger than the size of other said discharge ports, at least one recessed portion or more are provided and if said non-discharging nozzle is substantially a same size as other said discharge ports or smaller, at least three recessed portions are provided.

84. An ink jet recording head according to claim 75, wherein said ink jet recording head discharges ink droplets by utilization of heat generated by an electrothermal converting element.

85. An ink jet recording head according to claim 76, wherein said ink jet recording head discharges ink droplets by utilization of heat generated by an electrothermal converting element.

86. An ink jet recording head according to claim 77, wherein said ink jet recording head discharges ink droplets by utilization of heat generated by an electrothermal converting element.

87. An ink jet recording apparatus for performing recording by discharging ink for a recording head, wherein said ink jet recording apparatus comprises:

a cleaning member which moves, relative to the ink jet recording head, into contact with a surface provided with an ink discharge port and having an area provided with said ink discharge port for discharging ink and which serves to clean said area; and a supporting member for mounting therein the recording head, said recording head comprising a non-discharging nozzle provided at said area and in a vicinity of said ink discharge port, said non-discharging nozzle being positioned in a route of said cleaning member moving in contact with said ink discharge port and upstream of other said ink discharge ports with respect to a moving direction of said cleaning member as it moves relative to the ink jet head and relative to the surface on which the ink discharge port is formed.

88. An ink jet recording apparatus according to claim 87, wherein said discharge port corresponding to said non-discharging nozzle is of a size which is 0.5 times or more and 3 times or less that of other said discharge ports.

89. An ink jet recording apparatus according to claim 87, wherein if said discharge port corresponding to said non-discharging nozzle is larger than the size of other said discharge ports, at least one recessed portion or more are provided and if said non-discharging nozzle is substantially a same size as other said discharge ports or smaller, at least three recessed portions are provided.

90. An ink jet recording apparatus according to claim 87, wherein said ink jet recording head discharges ink droplets by utilization of heat generated by an electrothermal converting element.

91. An ink jet recording apparatus according to claim 87, wherein said cleaning member travels relatively in the direction parallel to the direction in which said recording head travels to scan.

* * * * *

UNITED STATES PATENT AND TRADEMARK OFFICE

CERTIFICATE OF CORRECTION

PATENT NO. : 5,710,580

DATED : January 20, 1998

INVENTOR(S) : NAOJI OTSUKA, ET AL.

It is certified that error appears in the above-identified patent and that said Letters Patent is hereby corrected as shown below:

COLUMN 4

Line 37, "sforesaid" should read --aforesaid--.

COLUMN 7

Line 30, "will" should read --will be--.

COLUMN 15

Line 23, "position" should read --positions--.

COLUMN 18

Line 31, "particles" should read --particle--.

COLUMN 19

Line 1, "form" should read --from--; and
Line 52, "an" should read --a--.

COLUMN 21

Line 41, "foe" should read --for--.

COLUMN 25

Line 5, "damand" should read --demand--.

UNITED STATES PATENT AND TRADEMARK OFFICE

CERTIFICATE OF CORRECTION

PATENT NO. : 5,710,580

DATED : January 20, 1998

INVENTOR(S) : NAOJI OTSUKA, ET AL.

It is certified that error appears in the above-identified patent and that said Letters Patent is hereby corrected as shown below:

COLUMN 26

Line 65, "of" should read --as--.

Signed and Sealed this

Twenty-eighth Day of July, 1998

Bruce Lehman

*Attest:*

BRUCE LEHMAN

*Attesting Officer*

*Commissioner of Patents and Trademarks*